US009938684B1

(12) United States Patent
Kang

(10) Patent No.: US 9,938,684 B1
(45) Date of Patent: Apr. 10, 2018

(54) GUIDE ASSEMBLY FOR GUIDING A CASING USED IN FORMING A SHEATHING WALL IN A GROUND AND A METHOD FOR FORMING A SHEATHING WALL IN A GROUND USING THE SAME

(71) Applicant: Han Ju Kang, Busan (KR)

(72) Inventor: Han Ju Kang, Busan (KR)

( * ) Notice: Subject to any disclaimer, the term of this patent is extended or adjusted under 35 U.S.C. 154(b) by 0 days.

(21) Appl. No.: 15/640,584

(22) Filed: Jul. 3, 2017

(30) Foreign Application Priority Data

May 31, 2017 (KR) ..... 10-2017-0067556

(51) Int. Cl.
*E02D 19/12* (2006.01)
*E02D 17/08* (2006.01)
*E02D 31/02* (2006.01)

(52) U.S. Cl.
CPC ..... *E02D 17/08* (2013.01); *E02D 19/12* (2013.01); *E02D 31/02* (2013.01)

(58) Field of Classification Search
CPC ..... E02D 3/12; E02D 19/12
USPC ..... 405/267, 270
See application file for complete search history.

(56) References Cited

U.S. PATENT DOCUMENTS 4,917,543 A * 4/1990 Cole ..... E02D 5/04 256/73
5,106,233 A * 4/1992 Breaux ..... B09B 1/008 405/129.8
5,240,348 A * 8/1993 Breaux ..... B09B 1/008 405/129.8
5,259,705 A * 11/1993 Breaux ..... B09B 1/008 405/129.8
5,354,149 A * 10/1994 Breaux ..... B09B 1/008 405/129.6
5,487,622 A * 1/1996 Cherry ..... B09C 1/002 210/170.07
6,240,700 B1 * 6/2001 Sheu ..... E02D 5/20 405/267
6,394,703 B1 * 5/2002 Renouf ..... E02D 9/005 405/232
9,212,462 B2 * 12/2015 Borel ..... E02D 17/13

FOREIGN PATENT DOCUMENTS

KR 10-2006-0024185 A 3/2006
KR 10-1344096 B1 12/2013
KR 10-1492858 B1 2/2015
KR 10-1738884 B1 6/2017

* cited by examiner

*Primary Examiner* — Frederick L Lagman
(74) *Attorney, Agent, or Firm* — Patent Office of Dr. Chung Park

(57) ABSTRACT

There is provided a guide assembly for guiding a cylindrical casing used in forming a sheathing wall in a ground. The guide assembly includes: a first guide-body having first inner and outer vertical faces and first top and bottom horizontal faces extending in a length-direction thereof; a second guide-body having second inner and outer vertical faces and top and bottom horizontal faces extending in a length-direction thereof, wherein the second inner face faces away the first inner face; at least one first coupling unit configured to couple the first and second guide-bodies to each other at the first and second top faces thereof; and at least one second coupling unit configured to couple the first and second guide-bodies to each other at lower positions of the first and second inner faces thereof.

17 Claims, 23 Drawing Sheets

【FIG. 1】
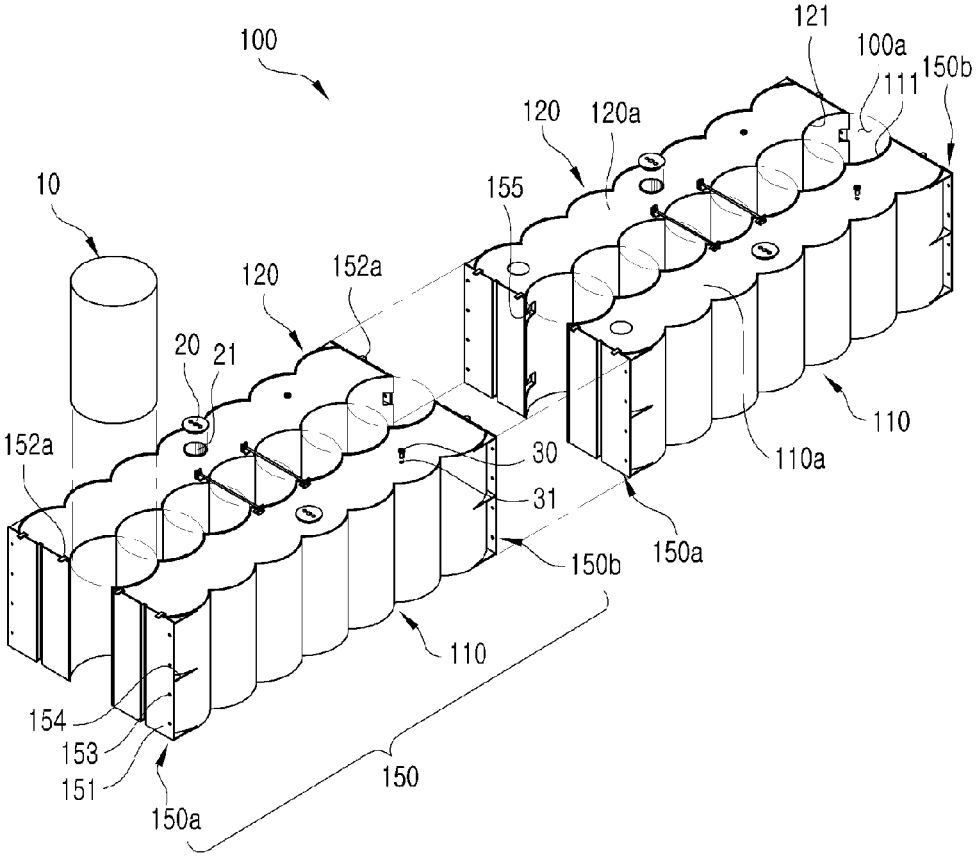

【FIG. 2】
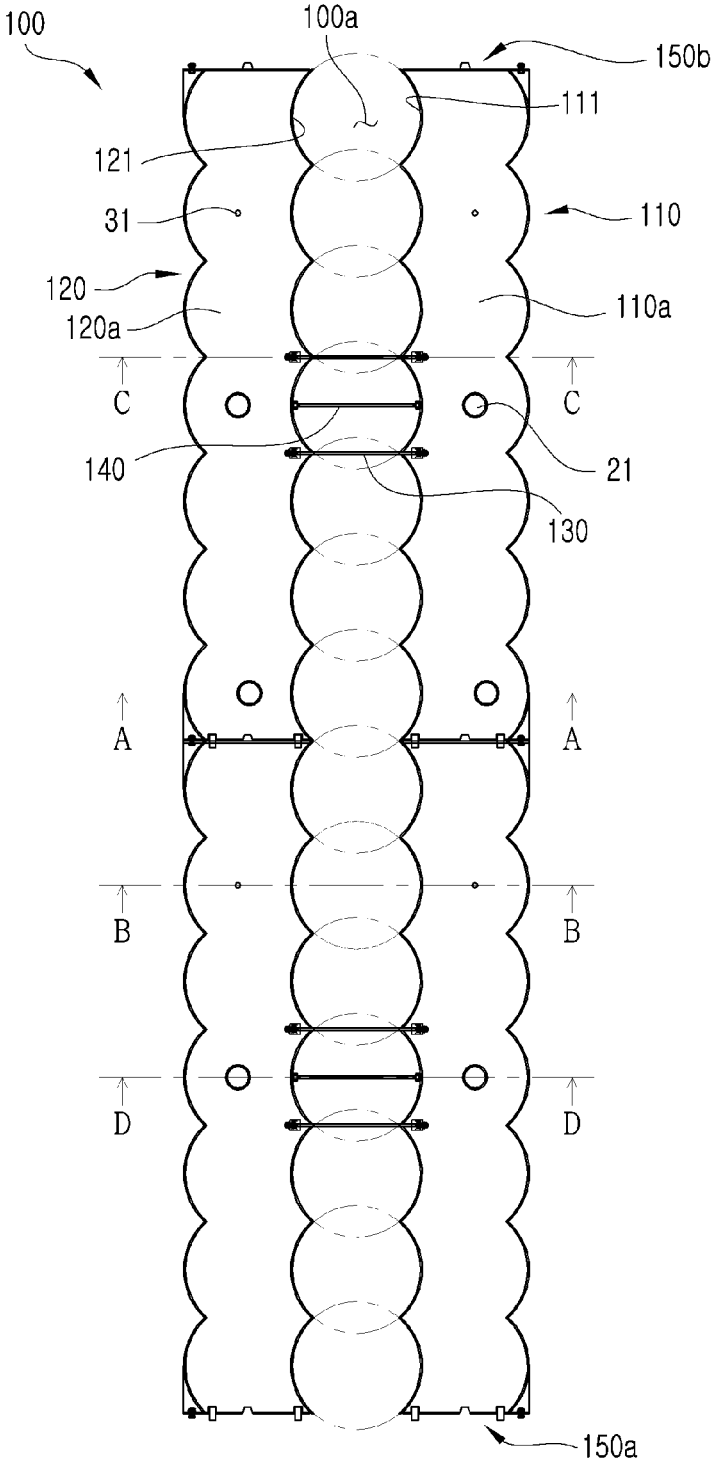

【FIG. 3A】
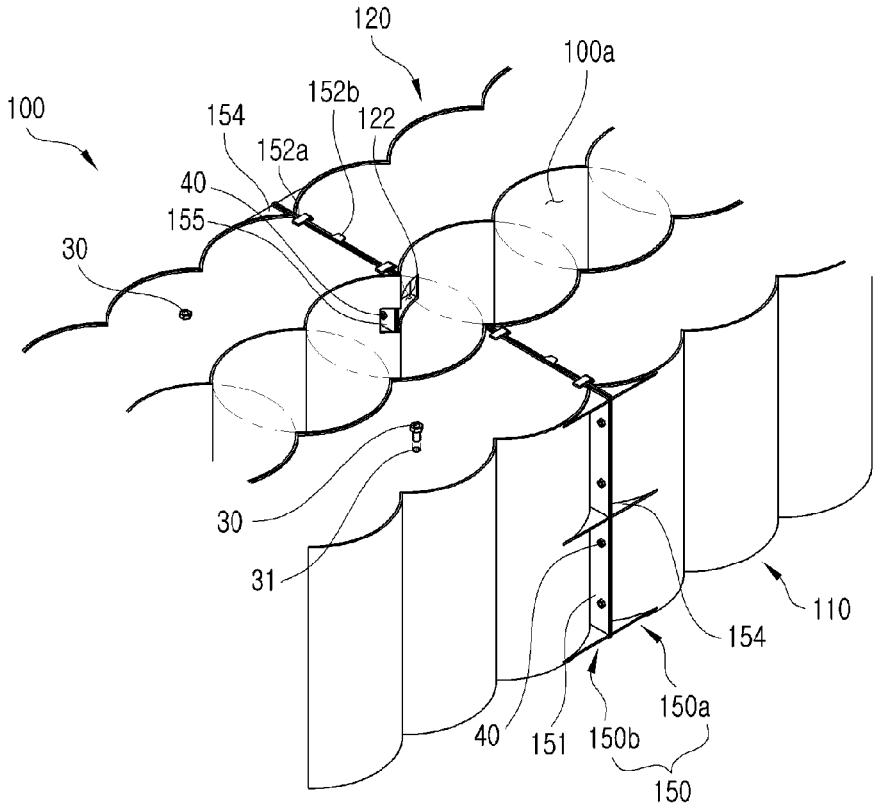
【FIG. 3B】
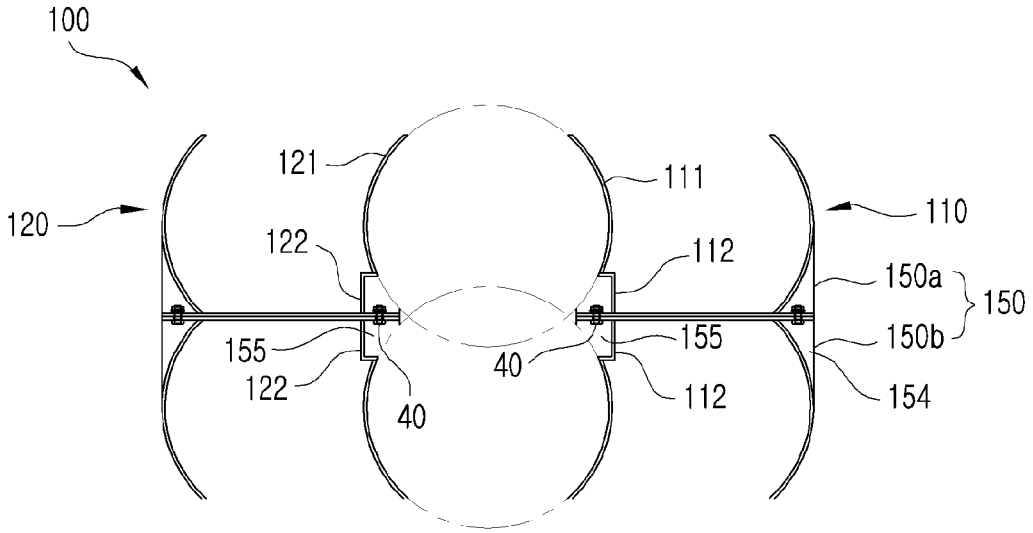

【FIG. 3C】
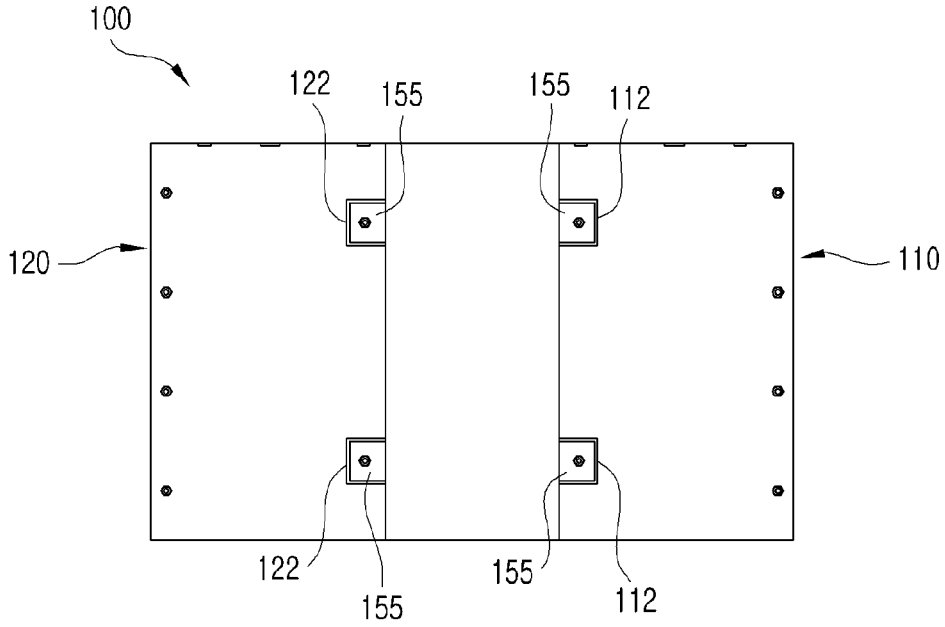

【FIG. 4】
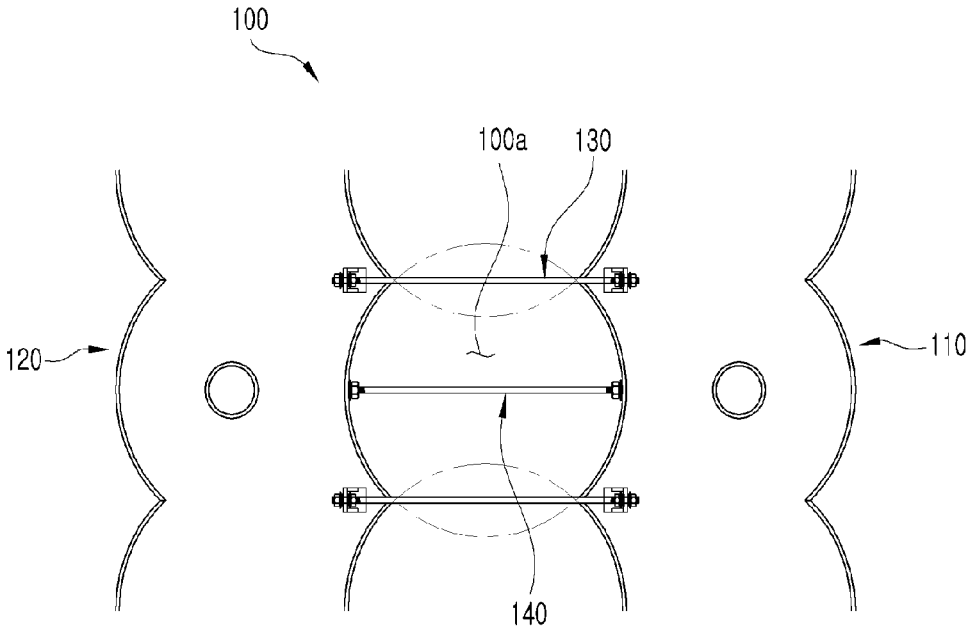

【FIG. 5】
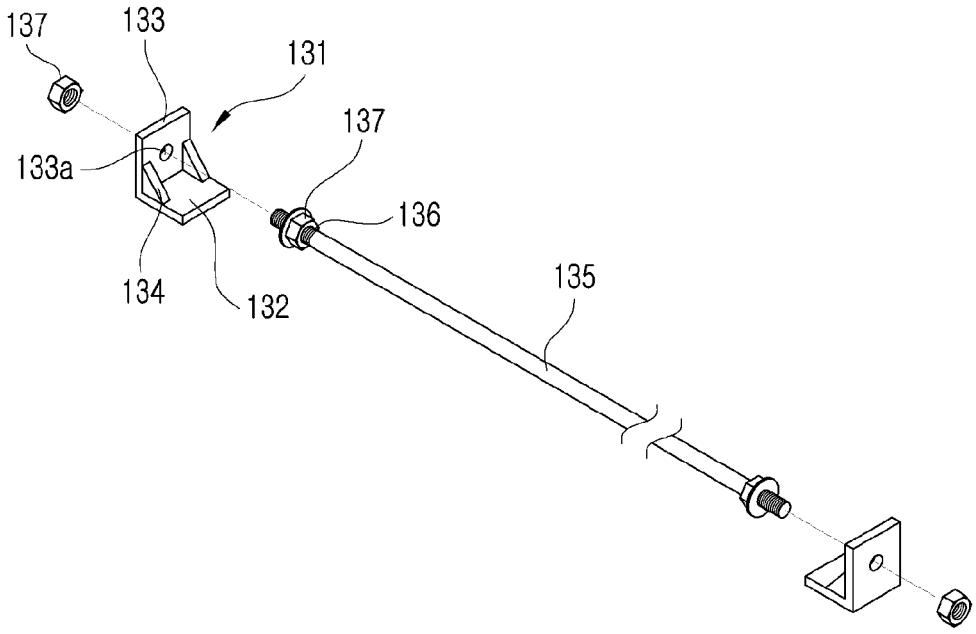
【FIG. 6A】
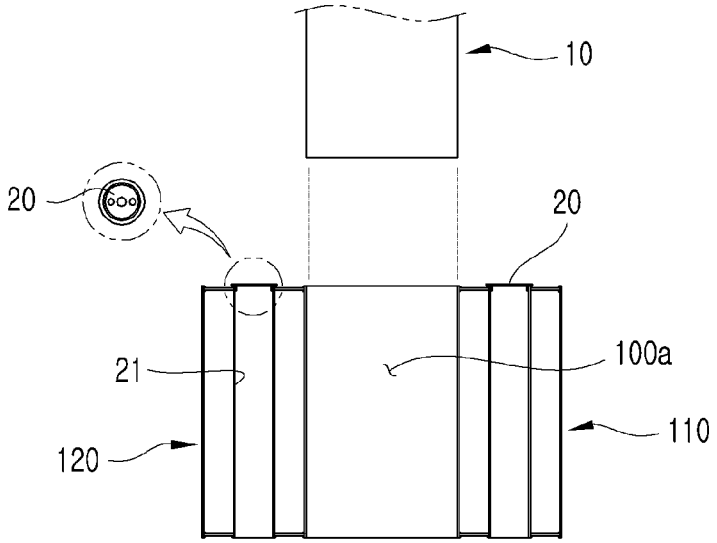

【FIG. 6B】
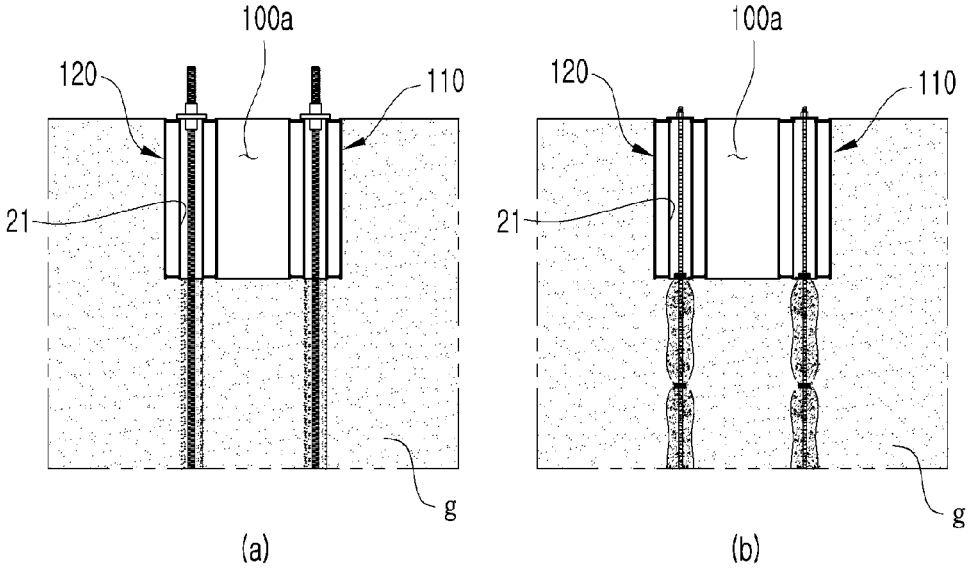
【FIG. 7】
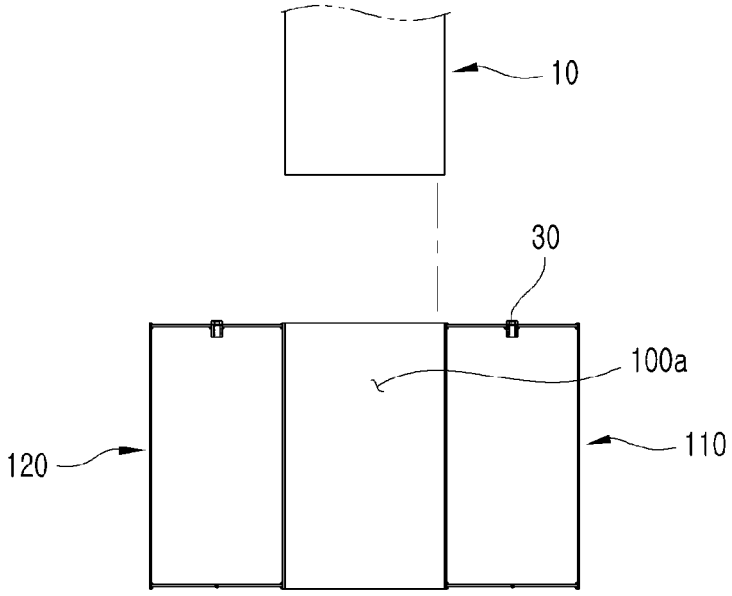

【FIG. 8A】
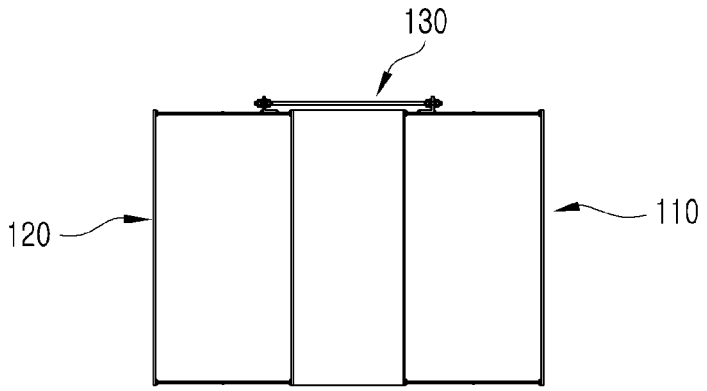
【FIG. 8B】
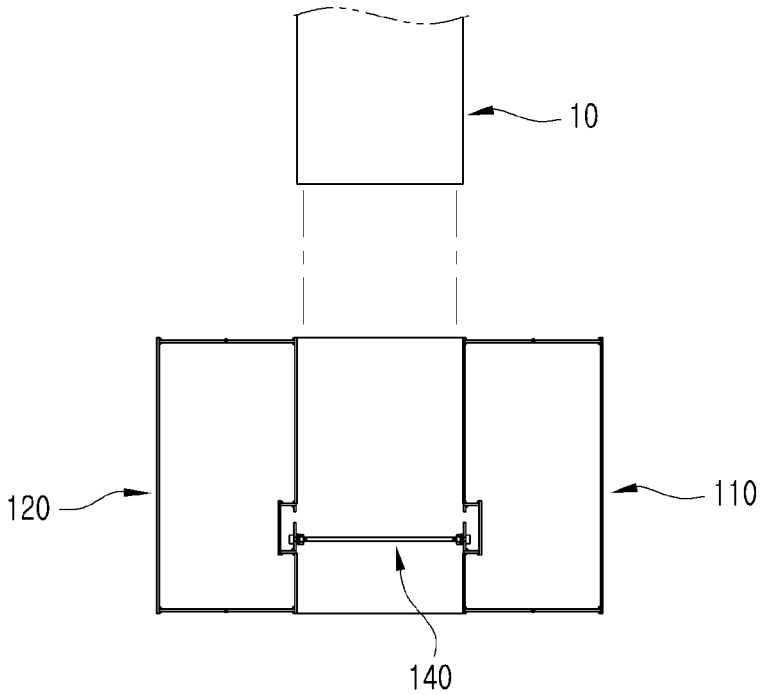

【FIG. 9】
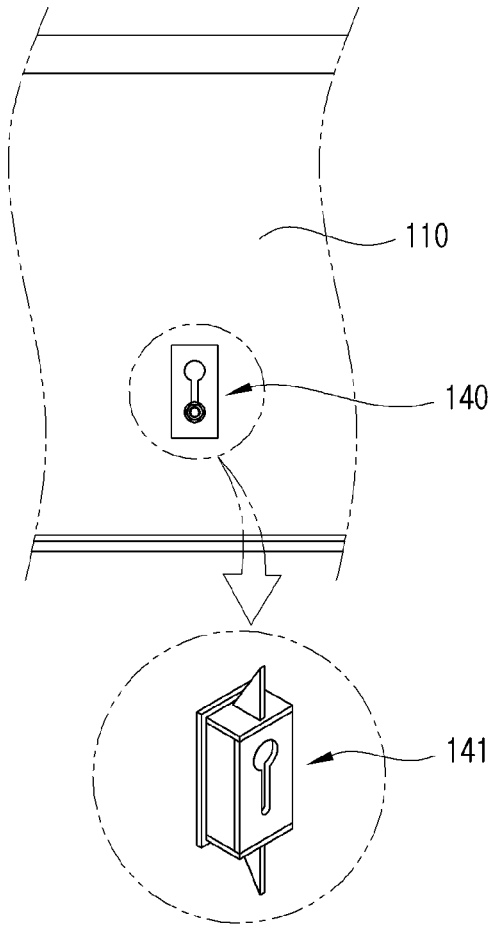

【FIG. 10】
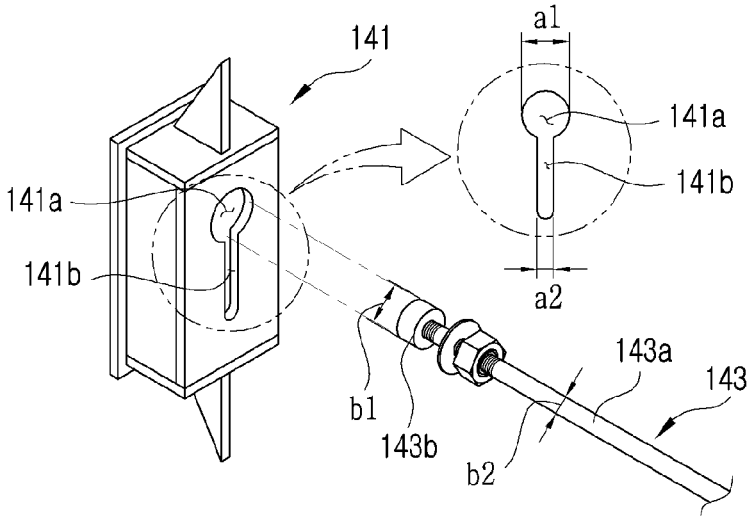
【FIG. 11】
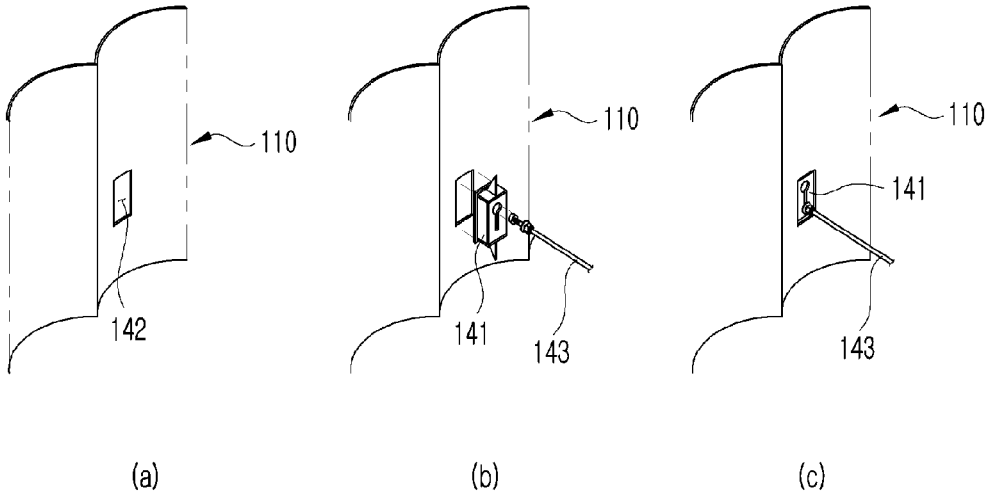

【FIG. 12】
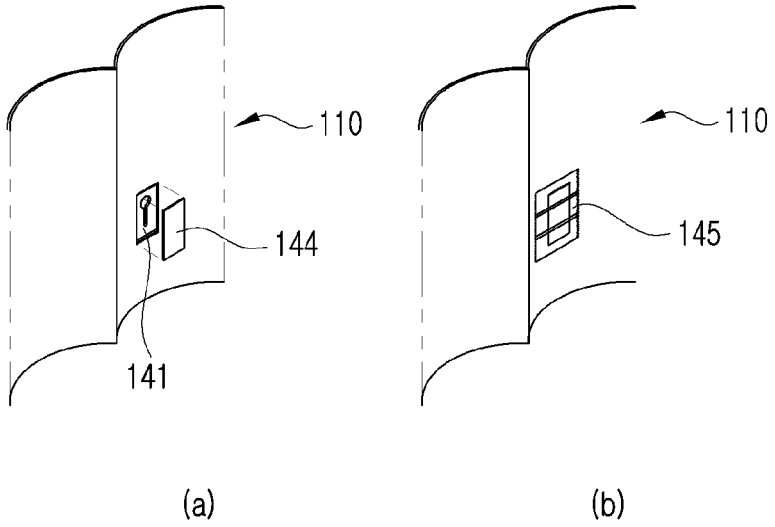

【FIG. 13】
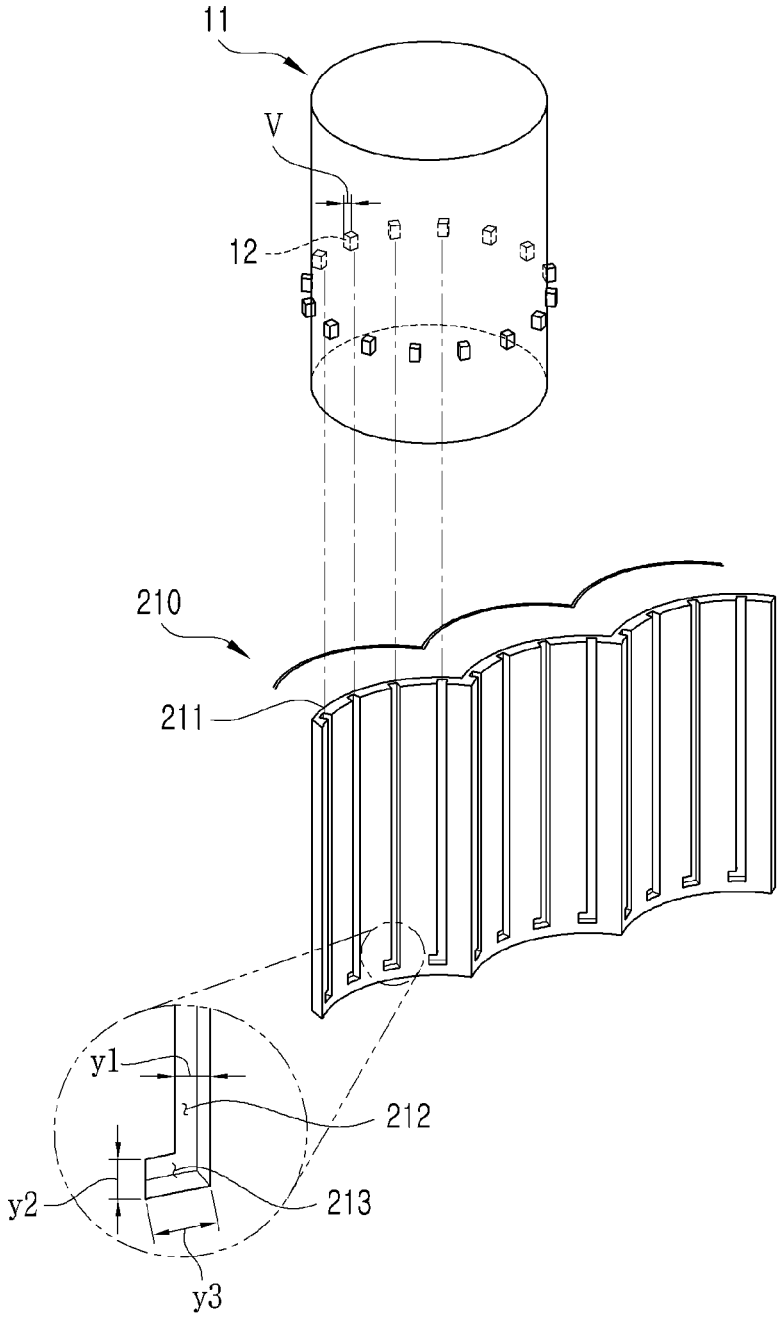

【FIG. 14】
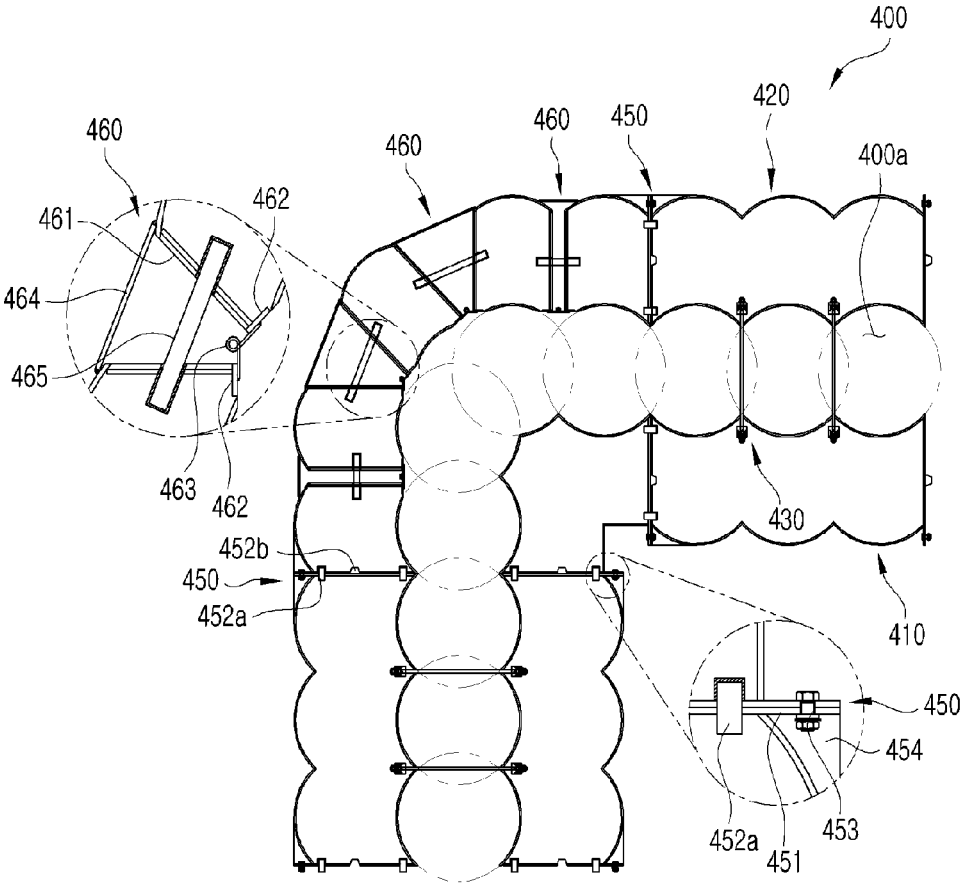

【FIG. 15】
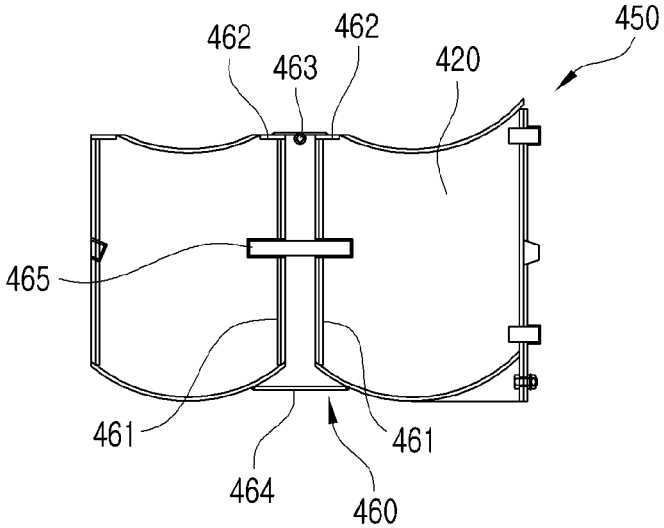
【FIG. 16】
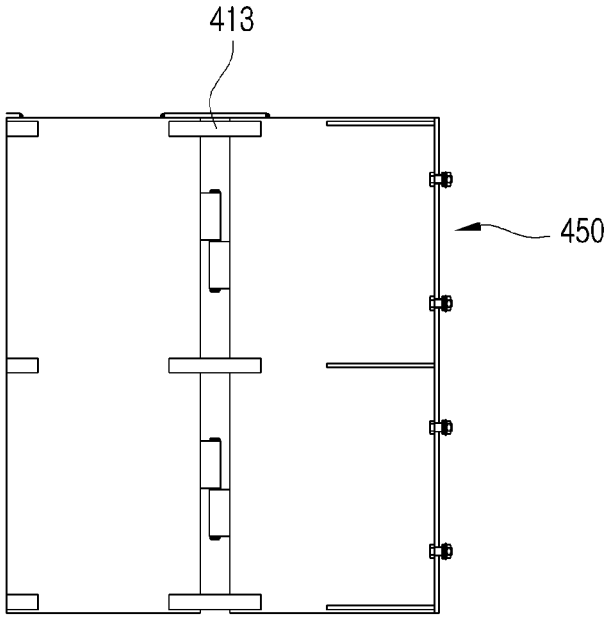

【FIG. 17】
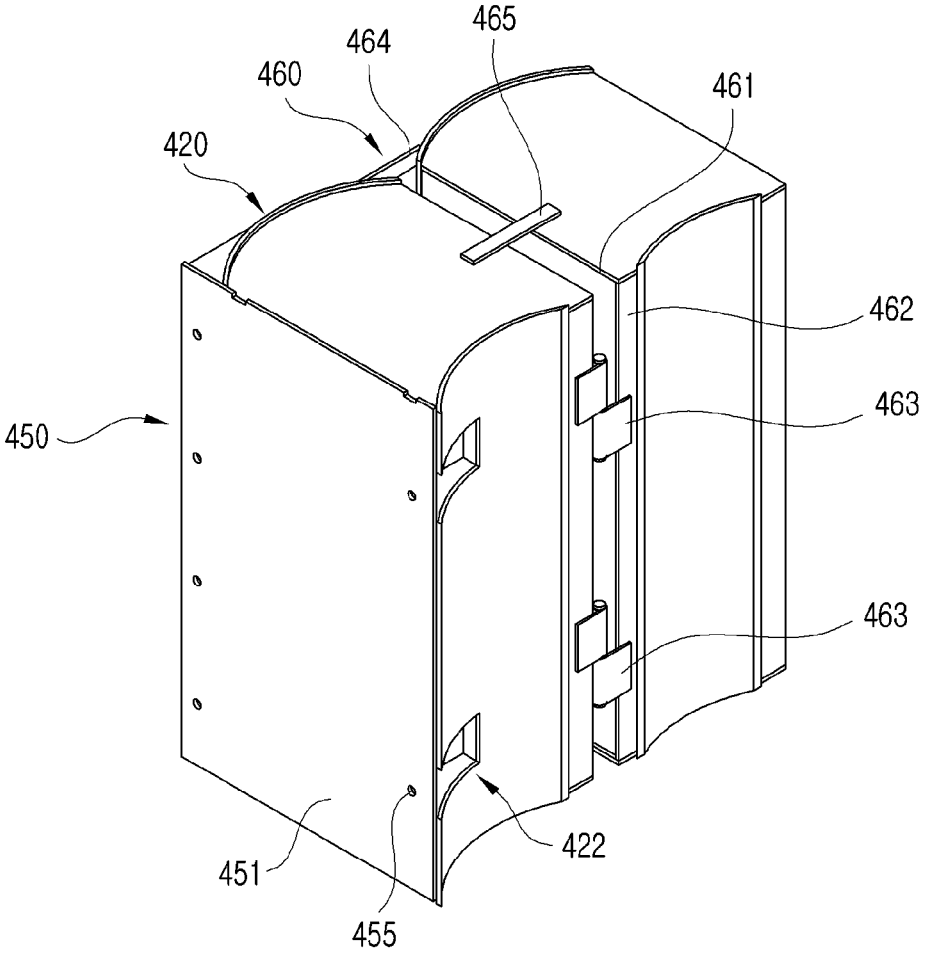

【FIG. 18A】
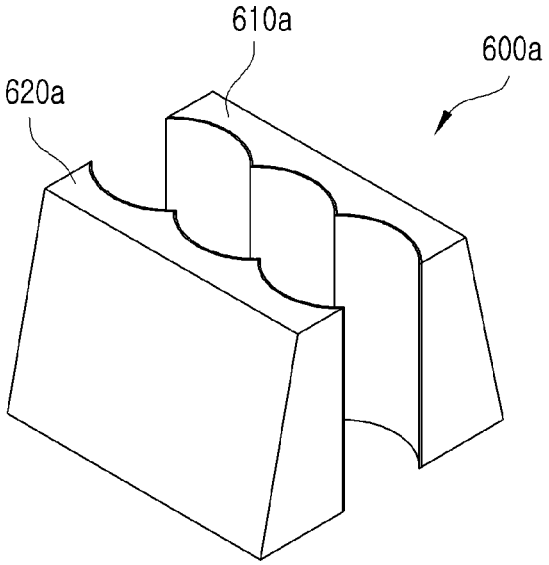
【FIG. 18B】
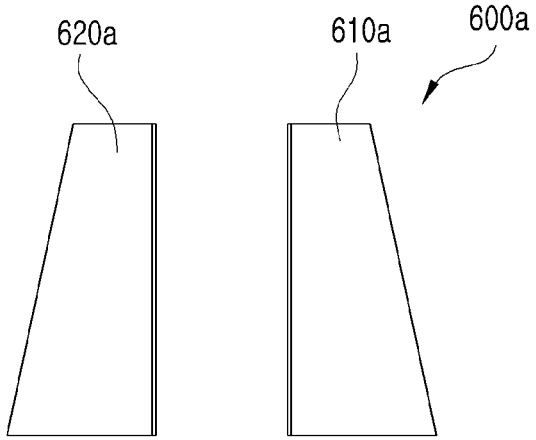

【FIG. 19A】
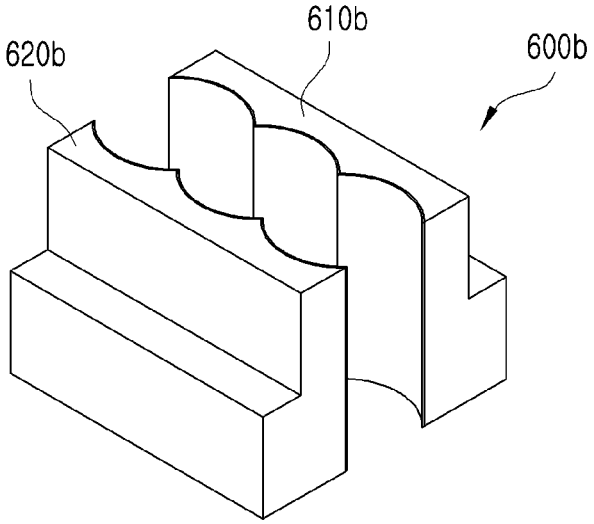
【FIG. 19B】
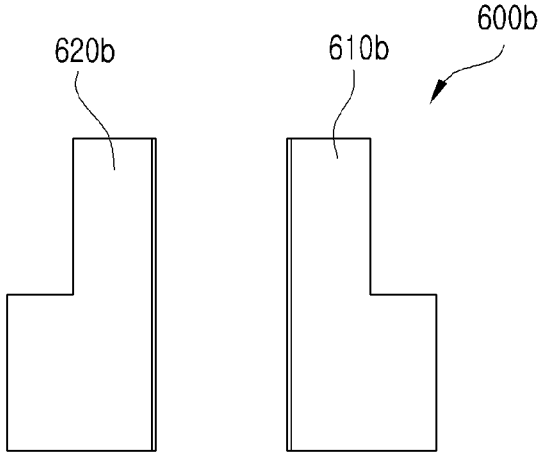

【FIG. 20A】
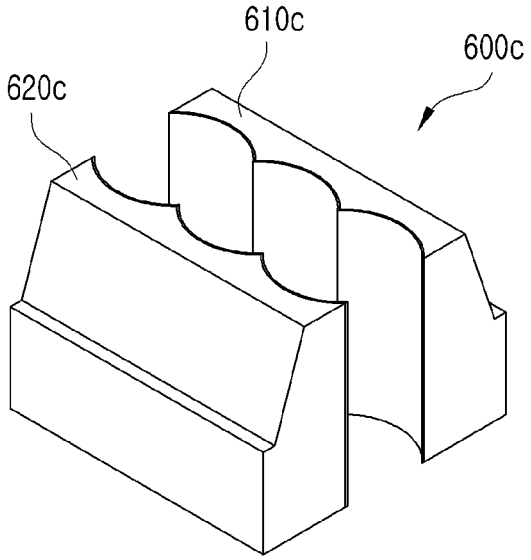
【FIG. 20B】
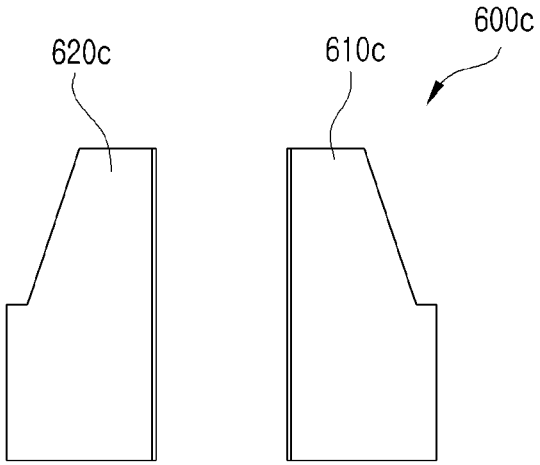

【FIG. 21A】
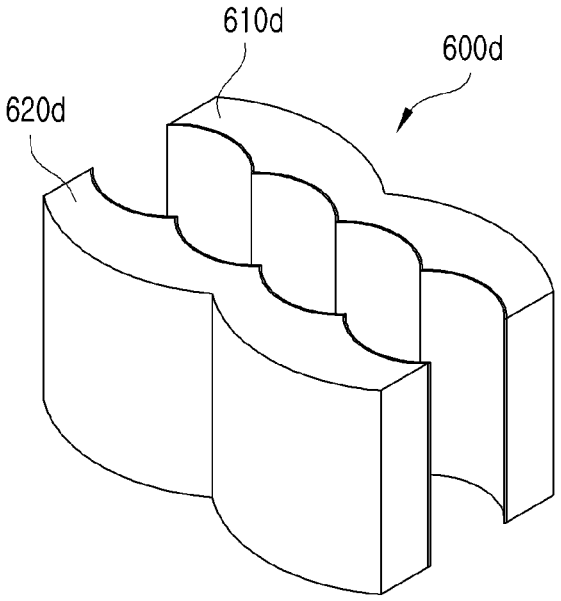
【FIG. 21B】
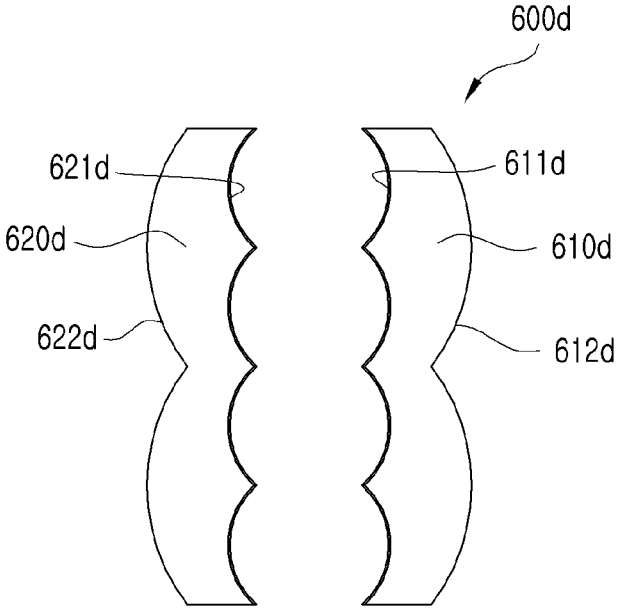

【FIG. 22A】
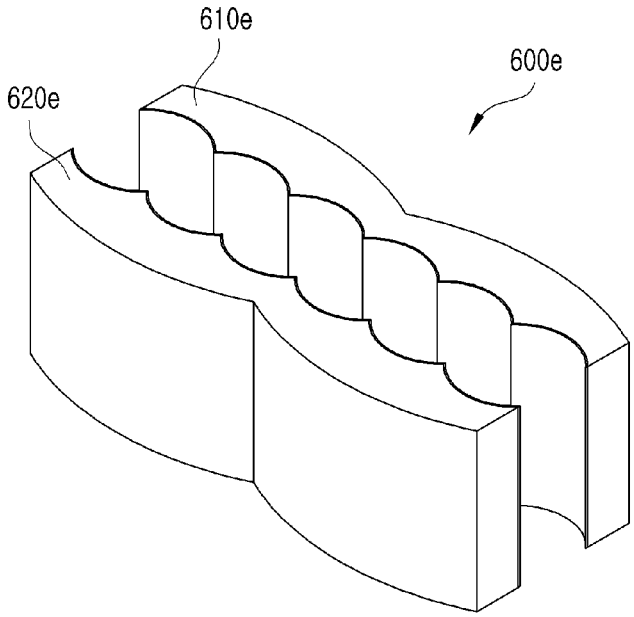
【FIG. 22B】
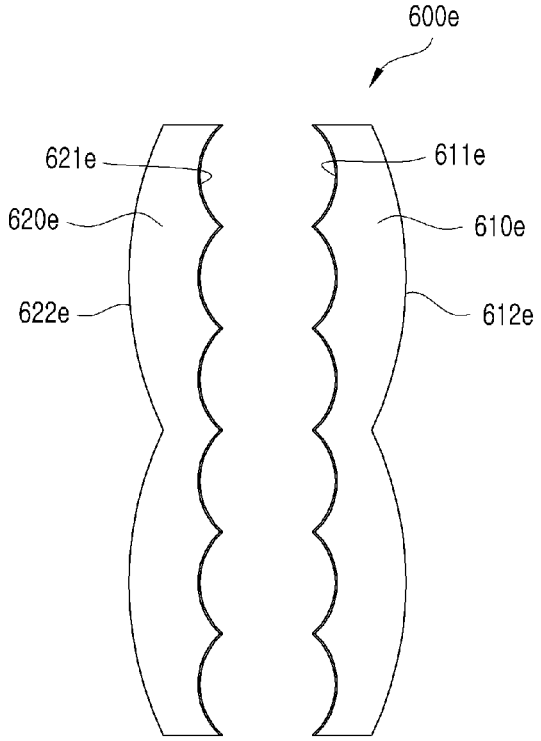

【FIG. 23A】
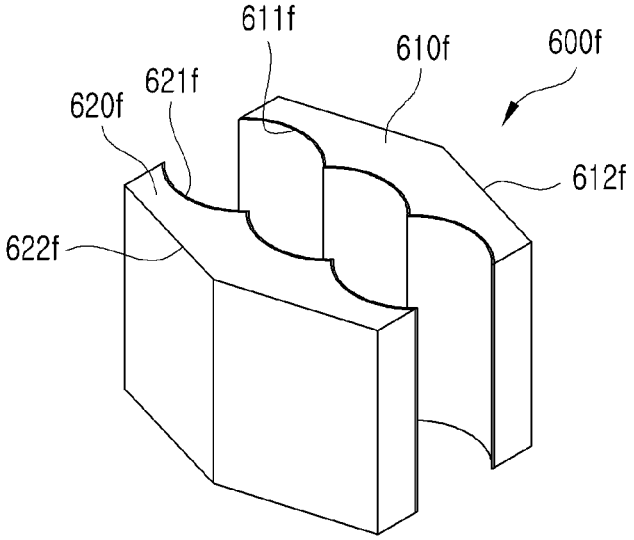
【FIG. 23B】
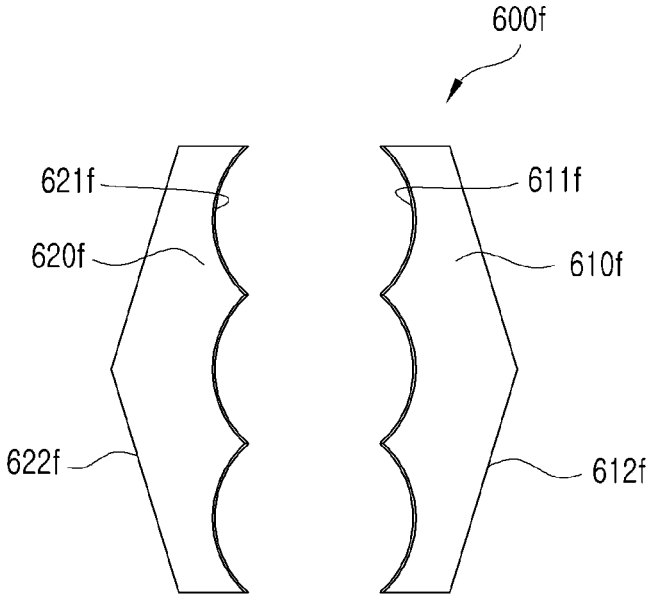

【FIG. 24】
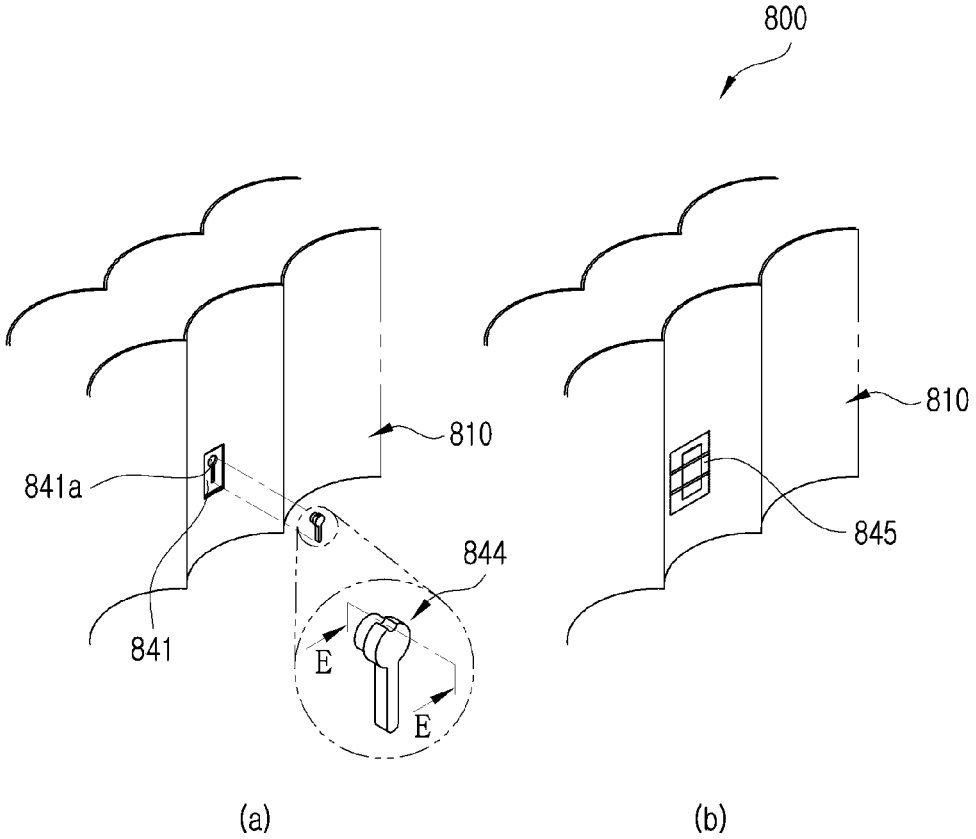
【FIG. 25】
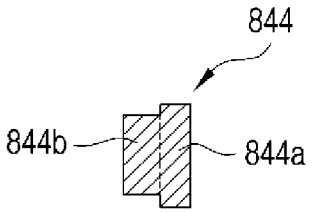

【FIG. 26】
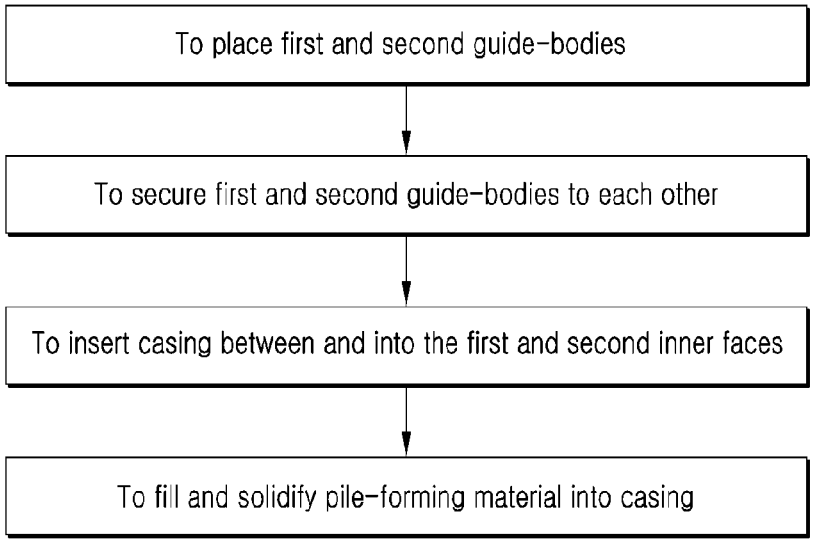

GUIDE ASSEMBLY FOR GUIDING A CASING USED IN FORMING A SHEATHING WALL IN A GROUND AND A METHOD FOR FORMING A SHEATHING WALL IN A GROUND USING THE SAME

BACKGROUND

Field of the Present Disclosure

The present invention relates to a guide assembly for guiding a casing used in forming a sheathing wall in a ground and a method for forming a sheathing wall in a ground using the same. More particularly, the present invention relates to a guide assembly for guiding a casing used in forming a sheathing wall in a ground where the guide assembly is reusable and enables improved water blocking. Further, the present invention relates to a method for forming a sheathing wall in a ground using the guide assembly.

Discussion of Related Art

Generally, in order to construct various underground facilities, the H-beam should be buried underground or the sheathing wall made of concrete should be installed in the ground. A variety of construction methods and excavators have been used to embed the H-beams therein or to install the concrete sheathing wall therein. In addition, in order to construct various structures such as an apartment, a building, or a bridge, a foundation trench construction is performed by excavating the ground by a predetermined depth.

The foundation trench construction is carried out in advance in order to provide an installation space of a structure in a building construction and a civil engineering work. At this time, it is general to install the sheathing wall so that a surrounding ground does not collapse toward the foundation trench. This sheathing wall is constructed to withstand an earth pressure of the surrounding ground.

When, in the foundation trench construction, the underground water or infiltrating water flows through the excavated ground and then is erupted from the foundation trench, there is a risk that a strength and safety of the structure to be constructed may be detrimentally affected. Therefore, the sheathing wall should have a water blocking function to prevent the water passing through the surrounding ground from flowing into the installation space of the structure, in addition to the ability to withstand the earth pressure of the surrounding ground.

One of sheathing wall forming methods is a cast-in place pile CIP method. In this CIP method, a hole of a predetermined size is drilled in the ground, and thereafter, a concrete or a mortar is filled in the hole to form a columnar pile. Further, a plurality of piles are connected to each other in a line to form a continuous-pile type sheathing wall. Such continuous-pile type sheathing wall is currently formed by various construction methods.

In one example of forming such continuous-pile type sheathing wall, a plurality of tubular casings are inserted at a certain depth in the ground and are arranged in a line. While this arrangement of the casings acts as a form, a pile-forming material such as concrete or mortar is filled and solidified into the casings. As a result, such continuous-pile type sheathing wall is manufactured at a construction site.

In such a conventional CIP method, the piles are brought into contact with each other with a certain area so that a gap is not generated between the piles connected to each other. However, when the piles are formed independently of each other and the piles are joined together, at least one of the piles may be oriented not exactly perpendicularly to the ground surface. Thus, there occurs a problem that a gap is generated between the piles. When such a gap is formed, the water blocking function of the continuous-pile type sheathing wall is remarkably deteriorated. Thus, there is a need for a development of a method for inserting the casing into the ground exactly perpendicularly to the ground surface so that such gaps are created in the continuous-pile type sheathing wall.

In this connection, the method for inserting the casing into the ground exactly perpendicularly to the ground surface is disclosed in Korean Patent application publication No. 10-2006-0024185. In this patent document, a guide structure is formed directly on site, wherein the guide structure has a guide hole for guiding the casing. Then, concrete is placed and hardened in the guide structure acting as a mold. Thereafter, the casing is vertically inserted into the guide structure. However, in this approach, for each region in which each pile is installed, the worker must individually fabricate each guide structure. In addition, a further work cannot be performed until the concrete filled in the guide structure is cured. This may lead to a poor construction efficiency. Above all, once the casing has constructed, the guide structure must be removed. As a result, the guide structure cannot be reused, resulting in a waste of resources.

Therefore, various studies are under way to improve the water blocking effect of the continuous-pile type sheathing wall by placing the casing exactly perpendicularly, and, further, to perform the foundation trench construction efficiently.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

Generally, the present invention is to provide a guide assembly for guiding a casing used in forming a sheathing wall in a ground and a method for forming a sheathing wall in a ground using the same.

One aim of the present invention is to provide a guide assembly for guiding a casing used in forming a sheathing wall in a ground where the guide assembly enables formation of a continuous-pile type sheathing wall with improved water blocking. Further, the present invention is to provide a method for forming a sheathing wall in a ground using the guide assembly.

Another aim of the present invention is to provide a guide assembly for guiding a casing used in forming a sheathing wall in a ground where the guide assembly is reusable, resulting in economical and eco-friendly guide assembly. Further, the present invention is to provide a method for forming a sheathing wall in a ground using the guide assembly.

Still another aim of the present invention is to provide a guide assembly for guiding a casing used in forming a sheathing wall in a ground where first and second coupling units allow firm securement between first and second guide-bodies, and first and second anchoring-bars are inserted through first and second anchoring-bar guide channels defined in the first and second guide-bodies respectively into the ground, thereby to suppress movement of the first and second guide-bodies. This may allow formation of a continuous-pile type sheathing wall free of a gap. Further, the present invention is to provide a method for forming a sheathing wall in a ground using the guide assembly.

Still another aim of the present invention is to provide a guide assembly for guiding a casing used in forming a sheathing wall in a ground where a plurality of concave-rounded vertically-extended portions are arranged in the length-direction and are connected to one another, thereby to allow uniform distribution of forces applied to the assembly and thus to improve durability thereof. Further, the present invention is to provide a method for forming a sheathing wall in a ground using the guide assembly.

In one aspect of the present invention, there is provided a guide assembly for guiding a cylindrical casing used in forming a sheathing wall in a ground, the assembly comprising: a first guide-body having first inner and outer vertical faces and first top and bottom horizontal faces extending in a length-direction thereof, wherein the first inner face is configured in a shape thereof such that a plurality of first concave-rounded vertically-extended portions are arranged the length-direction and are connected to one another; a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face; at least one first coupling unit configured to couple the first and second guide-bodies to each other at the first and second top faces thereof; and at least one second coupling unit configured to couple the first and second guide-bodies to each other at lower positions of the first and second inner faces thereof, wherein the plurality of first concave-rounded vertically-extended portions position-correspond to the plurality of second concave-rounded vertically-extended portions respectively to define a plurality of vertical casing-accommodation cylindrical spaces therebetween respectively, wherein each vertical casing-accommodation cylindrical space shape-corresponds to the cylindrical casing, wherein the second coupling unit includes: first and second box-accommodation recesses defined at the lower positions of the first and second inner faces respectively; and first and second coupling boxes inserted into the first and second box-accommodation recesses respectively.

In one implementation of the guide assembly, the second coupling unit further includes a lower connection member in a form of an elongate bar inserted through and secured to the first and second coupling boxes, wherein each of the first and second coupling boxes is hollow, wherein each of the first and second coupling boxes has an opening defined therein, wherein the lower connection member is inserted into the opening, wherein the opening includes a circular opening, and an elongate opening communicating with the circular opening and extending downwardly from the circular opening, wherein the lower connection member includes: an elongate body with a circular cross-section; and first and second heads disposed at both opposing ends of the elongate body respectively, wherein each of the first and second heads has a diameter greater than a diameter of the elongate body, wherein the circular opening has a diameter larger than the diameter of the elongated body of the lower connection member, wherein the width of the elongate opening is substantially equal to the diameter of the elongate body of the lower connection member, wherein a lower end of the elongate opening is formed in a semicircular shape having a diameter substantially equal to the diameter of the elongate body of the lower connection member.

In one implementation of the guide assembly, the guide assembly further includes first and second box covers to cover the first and second coupling boxes respectively inserted into the first and second openings, wherein each of the first and second box covers has a groove defined in an upper portion thereof; wherein each of the first and second box covers has an inner inserted head and an outer non-inserted shoulder integral with the inner inserted head, wherein when the second coupling unit is in an unengaged state, the inner head is inserted into the opening of each of the first and second boxes, and the outer shoulder is out of the opening.

In one implementation of the guide assembly, the first coupling unit includes: first and second L-shaped fixing members fixed to the first and second top faces of the first and second guide-bodies respectively; and an upper connection member in a form of an circular-cross sectional elongate bar extending between and fixed to the first and second fixing members, wherein each of the first and second fixing members includes: a horizontal portion in contact with each of the first and second top faces of the first and second guide-bodies; a vertical portion extending vertically from the horizontal portion and having a through-hole defined therein; and lateral inclined support portions inclindedly connecting the horizontal portion and the vertical portion to each other, wherein each of the horizontal portions of the first and second fixing members extends inwardly relative to each vertical portion such that the horizontal portions of the first and second fixing members face away each other and the vertical portions of the first and second fixing members face toward the first and second outer faces of the first and second guide-bodies respectively, wherein an thread is formed on an outer face of each of opposing end portions of the upper connection member, wherein each end portion of the upper connection member is inserted into the through-hole defined in each of the vertical portions of the first and second fixing members, wherein each end portion of the upper connection member is fixed to each of the vertical portions via an inner nut and an outer nut threaded with the thread while each vertical portion is interposed between the outer nut and the inner nut which tightly fasten the vertical portion.

In one implementation of the guide assembly, the guide assembly includes a first end-to-end connection unit connecting adjacent first guide-bodies to each other at facing ends thereof, and a second end-to-end connection unit connecting adjacent second guide-bodies to each other at facing ends thereof, wherein the first end-to-end connection unit includes: first adjacent plates disposed on facing ends of the adjacent first guide-bodies respectively, wherein each of the first adjacent plates protrudes laterally outwardly beyond each of the adjacent first guide-bodies; fixing ribs disposed on top ends of the first adjacent plates respectively to secure the adjacent first guide-bodies to each other; a first set of vertically arranged first fixing holes defined in the protruded portion of one of the first adjacent plates; a second set of vertically arranged first fixing holes defined in the protruded portion of the other of the first adjacent plates, wherein the first and second sets of first fixing holes position-correspond to each other, wherein the first and second sets of first fixing holes are commonly passed through by a plurality of fasteners; a first set of vertically arranged first support ribs respectively extending from one of the first adjacent plates along the outer face of one of the adjacent first guide-bodies;

and a second set of vertically arranged first support ribs respectively extending in a from the other of the first adjacent plates along the outer face of the other of the adjacent first guide-bodies, wherein the second end-to-end connection unit includes: second adjacent plates disposed on facing ends of the adjacent second guide-bodies respectively, wherein each of the second adjacent plates protrudes laterally outwardly beyond each of the adjacent second guide-bodies; fixing ribs disposed on top ends of the second adjacent plates respectively to secure the adjacent second guide-bodies to each other; a first set of vertically arranged second fixing holes defined in the protruded portion of one of the second adjacent plates; a second set of vertically arranged second fixing holes defined in the protruded portion of the other of the second adjacent plates, wherein the first and second sets of second fixing holes position-correspond to each other, wherein the first and second sets of second fixing holes are commonly passed through by a plurality of fasteners; a first set of vertically arranged second support ribs respectively extending from one of the second adjacent plates along the outer face of one of the adjacent second guide-bodies; and a second set of vertically arranged second support ribs respectively extending in a rounded manner from the other of the second adjacent plates along the outer face of the other of the adjacent second guide-bodies, wherein the adjacent first guide-bodies have a first recess portion recessed from the first inner faces of the adjacent first guide-bodies at a boundary region between the adjacent first guide-bodies, wherein an inner end of each of the first plates extends inwardly through the first recess portion into the casing-accommodation space, wherein the adjacent second guide-bodies have a second recess portion recessed from the second inner faces of the adjacent second guide-bodies at a boundary region between the adjacent second guide-bodies, wherein an inner end of each of the second plates extends inwardly through the second recess portion into the casing-accommodation space, wherein a first inner fastener is engaged into an inner hole defined in the inner end of each of the first plates while a first outer fastener is engaged into an outer hole defined in the outwardly protruded portion of the first plate, wherein a second inner fastener is engaged into an inner hole defined in the inner end of each of the second plates while a second outer fastener is engaged into an outer hole defined in the outwardly protruded portion of the second plate.

In one implementation of the guide assembly, the fixing ribs of each of the first and second end-to-end connection units include a first fixing rib and a second fixing rib, wherein the first fixing rib of the first end-to-end connection unit is configured to allow level-alignment between the facing ends of the adjacent first guide-bodies, wherein the first fixing rib of the second end-to-end connection unit is configured to allow level-alignment between the facing ends of the adjacent second guide-bodies, wherein the second fixing rib is shaped to an inverse L shape having a vertical portion and a horizontal portion, wherein the second fixing rib of the first end-to-end connection unit is disposed at one of the adjacent first plates, wherein the vertical portion thereof is engaged into a hole defined in a top portion of the other of the adjacent first guide-bodies, wherein the second fixing rib of the second end-to-end connection unit is disposed at one of the adjacent second plates, wherein the vertical portion thereof is engaged into a hole defined in a top portion of the other of the adjacent second guide-bodies.

In one implementation of the guide assembly, the casing guide assembly includes: a first end-to-end pivotal connection unit configured to connect adjacent and spaced first guide-bodies to each other at facing ends thereof in an end-to-end spaced manner; and a second end-to-end pivotal connection unit configured to connect adjacent and spaced second guide-bodies to each other at facing ends thereof in an end-to-end spaced manner, wherein the first end-to-end pivotal connection unit includes: adjacent and spaced first plates coupled to the adjacent and spaced first guide-bodies at facing ends thereof respectively; first adjacent and spaced coupling flanges, each flange configured to allow the coupling between each of the adjacent and spaced first plates at each of inner ends thereof and each of adjacent and spaced first guide-bodies at each of the inner faces thereof; a first hinge mechanism coupled to each of the first adjacent and spaced coupling flanges to allow a pivotal movement of each of the first adjacent and spaced coupling flanges and thus a pivotal movement of each of the adjacent and spaced first guide-bodies; a first outer support to connect the adjacent and spaced first guide-bodies at facing ends of the outer faces thereof; and a first connection bar to connect the adjacent and spaced first guide-bodies at facing ends of the top faces thereof, wherein the second end-to-end pivotal connection unit includes: adjacent and spaced second plates coupled to the adjacent and spaced second guide-bodies at facing ends thereof respectively; second adjacent and spaced coupling flanges, each flange configured to allow the coupling between each of the adjacent and spaced second plates at each of inner ends thereof and each of adjacent and spaced second guide-bodies at each of the inner faces thereof; a second hinge mechanism coupled to each of the second adjacent and spaced coupling flanges to allow a pivotal movement of each of the second adjacent and spaced coupling flanges and thus a pivotal movement of each of the adjacent and spaced second guide-bodies; a second outer support to connect the adjacent and spaced second guide-bodies at facing ends of the outer faces thereof; and a second connection bar to connect the adjacent and spaced second guide-bodies at facing ends of the top faces thereof.

In one implementation of the guide assembly, each of the first and second guide-bodies has an empty space at least partially formed therein, wherein first and second anchoring-bar guide channels vertically pass through the first and second guide-bodies respectively, wherein each of the top face portions of the first and second guide-bodies has: a first hole defined therein for introducing water into the empty space; and a second hole defined therein communicating with each of the first and second anchoring-bar guide channels, wherein the guide assembly has first and second covers, wherein the first cover blocks the first hole and the second cover blocks the second hole.

In one implementation of the guide assembly, one or more guide ribs protrude from an outer face of the casing, wherein one or more guide grooves are formed in each of the first and second concave-rounded vertically-extended portions, wherein the guide ribs are inserted and guided into one or more guide grooves respectively, wherein each of the guide ribs includes a projection, wherein each of the guide grooves includes: a vertical guide groove extending vertically from a top end to a lower portion of each of the first and second concave-rounded vertically-extended portions; and a horizontal guide groove horizontally extending from a lower end of the vertical guide groove by a first length, wherein the vertical groove communicates with the horizontal groove, wherein a width of the vertical guide groove is substantially equal to a width of each of the guide ribs, wherein the first length is longer than the width of each of the guide ribs.

In one implementation of the guide assembly, the first and second guide-bodies have the first and second outer faces respectively, wherein each outer face has a tilted plane, wherein each of the first and second outer faces of the first and second guide-bodies is tilted such that a width of each of the first and second guide-bodies gradually increases from a top to a bottom thereof.

In one implementation of the guide assembly, the first and second guide-bodies have the first and second outer faces respectively, each outer face being configured to be stepped outwardly in a middle level thereof, wherein each of the first and second outer faces of the first and second guide-bodies may be stepped such that a width of a bottom of each of the first and second guide-bodies is larger than a width of a top of each of the first and second guide-bodies.

In one implementation of the guide assembly, the first and second guide-bodies have the first and second outer faces respectively, each outer face being configured to be tilted outwardly downwardly from a top level to a middle level thereof and extend perpendicularly to each top face of the bodies from a middle level thereof to a bottom level thereof such that a width of a bottom level of each of the first and second guide-bodies is equal to a width of a middle level thereof and is larger than a width of a top level of each of the first and second guide-bodies.

In one implementation of the guide assembly, the first and second guide-bodies have the first and second outer faces respectively, each outer face being configured in a shape thereof such that a plurality of convex-rounded vertically-extended portions are arranged in the length-direction and are connected to one another, wherein each of the convex-rounded vertically-extended portions has a larger curvature than each of the concave-rounded vertically-extended portions, wherein one convex-rounded vertical portion corresponds to at least two concave-rounded vertically-extended portions.

In one implementation of the guide assembly, the first and second guide-bodies have the first and second outer faces respectively, each outer face being configured in a shape thereof such that a plurality of convex-shaped triangular-cross-sectional prisms are arranged in the length-direction and are connected to one another, and one of the convex-shaped triangular-cross-sectional prisms corresponds to at least three concave-rounded vertically-extended portions.

In another aspect of the present invention, there is provided a method for forming a sheathing wall in a ground using the guide assembly as defined above, wherein the method comprises: placing a first guide-body having first inner and outer vertical faces and first top and bottom horizontal faces extending in a length-direction thereof, wherein the first inner face is configured such that a plurality of first concave-rounded vertically-extended portions are arranged in a shape thereof the length-direction and are connected to one another; placing a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face; securing the first and second guide-bodies to each other; inserting a hollow casing between and into the first and second inner faces of the first and second guide-bodies; and filling and solidifying a pile-forming material into the hollow casing, wherein the first outer face of the first body is configured in a shape thereof such that a plurality of first convex-rounded vertically-extended portions are arranged in the length-direction and are connected to one another; and/or the second outer face of the second body is configured in a shape thereof such that a plurality of second convex-rounded vertically-extended portions are arranged in the length-direction and are connected to one another.

In one implementation of the method, securing the first and second guide-bodies to each other includes inserting first and second anchoring-bars through first and second anchoring-bar guide channels defined in the first and second guide-bodies respectively into the ground and/or filling water into an empty space defined in each of the first and second guide-bodies, thereby to suppress movement of the first and second guide-bodies, wherein each of the first and second guide-bodies has the empty space at least partially formed therein, wherein the first and second anchoring-bar guide channels vertically pass through the first and second guide-bodies respectively, wherein each of the top face portions of the first and second guide-bodies has a first hole defined therein for introducing water into the empty space; and a second hole defined therein communicating with each of the first and second anchoring-bar guide channels, wherein the guide assembly has first and second covers, wherein the first cover blocks the first hole and the second cover blocks the second hole, wherein each of anchoring-bars includes a micro-pile and a soil-nailing structure inserted through each of the first and second anchoring-bar guide channels into the ground.

In one implementation of the method, securing the first and second guide-bodies to each other includes using first and/or second coupling units, wherein the first coupling unit is configured to couple the first and second guide-bodies to each other at the first and second top faces thereof, wherein the second coupling unit is configured to couple the first and second guide-bodies to each other at lower positions of the first and second inner faces thereof, wherein the second coupling unit includes first and second box-accommodation recesses defined at the lower positions of the first and second inner faces respectively; first and second coupling boxes inserted into the first and second box-accommodation recesses respectively; and a lower connection member in a form of an elongate bar inserted through and secured to the first and second coupling boxes, wherein the lower connection member enables the coupling between the first and second guide-bodies at the lower positions of the first and second inner faces thereof.

The present invention has following advantageous effects to which the present invention is not limited:

First, the guide assembly enables formation of a continuous-pile type sheathing wall with improved water blocking.

Second, the guide assembly is reusable, resulting in economical and eco-friendly guide assembly.

Third, the first and second coupling units allow firm securement between the first and second guide-bodies, and the first and second anchoring-bars are inserted through the first and second anchoring-bar guide channels defined in the first and second guide-bodies respectively into the ground, thereby to suppress movement of the first and second guide-bodies. This may allow formation of a continuous-pile type sheathing wall free of a gap.

Fourth, the plurality of concave-rounded vertically-extended portions are arranged in the length-direction and are connected to one another, thereby to allow uniform distribution of forces applied to the assembly and thus to improve durability thereof.

BRIEF DESCRIPTION OF THE DRAWINGS

FIG. 1 is a perspective view of a guide assembly for guiding a casing in forming a sheathing wall in a ground according to one embodiment of the present invention.

FIG. 2 is a top view of a guide assembly for guiding a casing in forming a sheathing wall in a ground according to one embodiment of the present invention.

FIG. 3A is a perspective view showing a state where neighboring first and second guide-bodies are connected to each other according to one embodiment of the present invention.

FIG. 3B is a top view showing a state where neighboring first and second guide-bodies are connected to each other according to one embodiment of the present invention.

FIG. 3C is a cross-sectional view showing a state where neighboring first and second guide-bodies are connected to each other according to one embodiment of the present invention.

FIG. 4 is an enlarged view of first and second coupling units according to one embodiment of the present invention.

FIG. 5 is an exploded view of a first coupling unit according to one embodiment of the present invention.

FIG. 6A is a cross-sectional view taken along a line A-A of FIG. 2.

FIG. 6B is a view schematically showing an example using a anchoring-bar guide channel shown in FIG. 6A.

FIG. 7 is a cross-sectional view taken along a line B-B of FIG. 2.

FIG. 8A is a cross-sectional view taken along a line C-C of FIG. 2.

FIG. 8B is a cross-sectional view taken along a line D-D of FIG. 2.

FIG. 9 is a schematic illustration of a second coupling unit according to an embodiment of the present invention.

FIG. 10 is a perspective view of the second coupling unit of FIG. 9.

FIG. 11 is a view illustrating an engaged state of the second coupling unit of FIG. 9.

FIG. 12 is a view illustrating an unengaged state of the second coupling unit of FIG. 9.

FIG. 13 is a schematic view illustrating a guide assembly for guiding a casing in forming a sheathing wall in a ground according to one embodiment of the present invention.

FIG. 14 is a top view of a guide assembly for guiding a casing used in forming a sheathing wall in a ground, wherein the guide assembly extends at an angle of 90 degrees, according to one embodiment of the present invention.

FIG. 15 is a view schematically showing a top face of the assembly in FIG. 14.

FIG. 16 is a sectional view of the assembly in FIG. 14.

FIG. 17 is a perspective view of the assembly in FIG. 14.

FIG. 18A is a schematic view of a casing guide assembly according to one embodiment of the present invention.

FIG. 18B is a view schematically showing a front face of the assembly in FIG. 18A.

FIG. 19A is a schematic view of the casing guide assembly according to one embodiment of the present invention.

FIG. 19B is a view schematically showing a front face of the assembly in FIG. 19A.

FIG. 20A is a schematic view of a casing guide assembly according to one embodiment of the present invention.

FIG. 20B is a view schematically showing a front face of the assembly in FIG. 20A.

FIG. 21A is a schematic view of a casing guide assembly according to one embodiment of the present invention.

FIG. 21B is a view schematically showing a front face of the assembly in FIG. 21A.

FIG. 22A is a schematic view of a casing guide assembly according to one embodiment of the present invention.

FIG. 22B is a view schematically showing a front face of the assembly in FIG. 22A.

FIG. 23A is a schematic view of a casing guide assembly according to one embodiment of the present invention.

FIG. 23B is a view schematically showing a front face of the assembly in FIG. 23A.

FIG. 24 is a schematic illustration of a second coupling unit according to one embodiment of the present invention.

FIG. 25 is a sectional view taken along a line E-E in FIG. 14.

FIG. 26 is a flowchart illustrating a method for forming a sheathing wall in a ground using the guide assembly according to one of the present invention.

For simplicity and clarity of illustration, elements in the figures are not necessarily drawn to scale. The same reference numbers in different figures denote the same or similar elements, and as such perform similar functionality.

DETAILED DESCRIPTIONS

Examples of various embodiments are illustrated and described further below. It will be understood that the description herein is not intended to limit the claims to the specific embodiments described. On the contrary, it is intended to cover plate alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

FIG. 1 is a perspective view of a guide assembly for guiding a casing in forming a sheathing wall in a ground according to an embodiment of the present invention. FIG. 2 is a top view of the guide assembly of FIG. 1. FIG. 3A is a perspective view showing a state where neighboring first and second guide-bodies are connected to each other according to an embodiment of the present invention. FIG. 3B is a top view showing a state where neighboring first and second guide-bodies are connected to each other according to an embodiment of the present invention. FIG. 3C is a cross-sectional view showing a state where neighboring first and second guide-bodies are connected to each other according to an embodiment of the present invention. FIG. 4 is an enlarged view of first and second coupling units according to an embodiment of the present invention. FIG. 5 is an exploded view of a first coupling unit according to an embodiment of the present invention.

The guide assembly 100 for guiding a cylindrical casing used in forming a sheathing wall in a ground includes a first guide-body 110 having first inner and outer vertical faces and first top and bottom horizontal faces extending in a length-direction thereof, wherein the first inner face is configured in a shape thereof such that a plurality of first concave-rounded vertically-extended portions 111 are arranged in the length-direction and are connected to one another; a second guide-body 120 having second inner and outer vertical faces and top and bottom horizontal faces extending in a length-direction thereof, wherein the second inner face is configured in a shape thereof such that a plurality of second concave-rounded vertically-extended portions 121 are arranged in the length-direction and are connected to one another, wherein the second inner face faces away the first inner face; at least one first coupling unit 130 configured to couple the first and second guide-bodies 110 and 120 to each other at the first and second top faces 110*a* and 120*a* thereof; and at least one second coupling unit 140 configured to couple the first and second guide-bodies 110 and 120 to each other at lower positions of the first and second inner faces thereof. Further, the plurality of first concave-rounded vertically-extended portions 111 position-correspond to the plurality of second concave-rounded vertically-extended portions 121 respectively to define a plurality of vertical casing-accommodation cylindrical spaces 100*a* therebetween respectively, wherein each vertical casing-accommodation cylindrical space 100*a* shape-corresponds to the cylindrical casing. The second coupling unit 140 includes first and second box-accommodation recesses 142 defined at the lower positions of the first and second inner faces respectively, and first and second coupling boxes 141 inserted into the first and second box-accommodation recesses 142 respectively.

The guide assembly 100 for guiding the cylindrical casing may be used to form a continuous-pile type sheathing wall in the construction work or civil engineering work. The continuous-pile type sheathing wall may define an installation space of the structure. For example, each of cylindrical casings 10 may be guided to each of adjacent pile formation positions. Then, a pile-forming material such as concrete or mortar may be injected and solidified into each cylindrical casing 10. Thus, the continuous-pile type sheathing wall may be formed.

The casing guide assembly 100 may include the first guide-body 110 and the second guide-body 120. The first guide-body 110 and the second guide-body 120 together define the vertical casing accommodation space 100*a*. The cylindrical casing 10 is inserted and guided into the vertical casing accommodation space 100*a*.

The first guide-body 110 has the first inner and outer vertical faces and first top and bottom horizontal faces extending in a length-direction thereof. The first inner face is configured in a shape thereof such that the plurality of first concave-rounded vertically-extended portions 111 are arranged in the length-direction and are connected to one another. The second guide-body 120 has the second inner and outer vertical faces and top and bottom horizontal faces extending in a length-direction thereof. The second inner face is configured in a shape thereof such that the plurality of second concave-rounded vertically-extended portions 121 are arranged in the length-direction and are connected to one another. The first and second inner faces face away from each other.

In one embodiment, each of the first and second guide-bodies 110 and 120 may be plural. The number of the first and second guide-bodies 110 and 120 may depend on a dimension of a foundation trench and a dimension of the continuous-pile type sheathing wall. The plurality of the first guide-bodies 110 may be coupled to each other, while the plurality of the second guide-bodies 120 may be coupled to each other. In this connection, the guide assembly 100 includes a first end-to-end connection unit 150 connecting adjacent first guide-bodies 110 to each other at facing ends thereof, and a second end-to-end connection unit 150 connecting adjacent second guide-bodies 120 to each other at facing ends thereof. In this way, via the first and second end-to-end connection units 150, the first guide-bodies 110 may be connected to each other in a length direction while the second guide-bodies 120 may be connected to each other in a length direction.

In one embodiment, the inner face portion of each of the first body 110 and second body 120 may be embodied as a sequential connection between a plurality of inner semi-circular hollow cylindrical steel tubes. The outer face portion of each of the first body 110 and second body 120 may be embodied as a sequential connection between a plurality of outer semi-circular hollow cylindrical steel tubes. The first inner and outer faces are spaced from each other such that fluid such as water fills in therebetween, while the second inner and outer faces are spaced from each other such that fluid such as water fills in therebetween. Thus, this may prevent movement of the first and second guide-bodies 110 and 120 during installation thereof.

As described above, the first end-to-end connection unit 150 is configured to connect the adjacent first guide-bodies 110 to each other at the facing ends thereof. The second end-to-end connection unit 150 is configured to connect the adjacent second guide-bodies 120 to each other at the facing ends thereof. In this way, via the first and second end-to-end connection units 150, the first guide-bodies 110 may be connected to each other in a length direction while the second guide-bodies 120 may be connected to each other in a length direction. That is, the adjacent first guide-bodies 110 may be coupled to each other in an end-to-end manner via the first end-to-end connection unit 150. The adjacent second guide-bodies 120 may be coupled to each other in an end-to-end manner via the second end-to-end connection unit 150. In this way, the connection of the adjacent first guide-bodies 110 may extend in the length-direction of the present casing guide assembly 100. The connection of the adjacent second guide-bodies 120 may extend in the length-direction of the present casing guide assembly 100.

In one embodiment, the first end-to-end connection unit 150 to connect the adjacent first guide-bodies 110 to each other may include a first end-to-end connection sub-unit 150*a* disposed at one of the adjacent first guide-bodies 110, and a second end-to-end connection sub-unit 150*b* disposed at the other of the adjacent first guide-bodies 110. In one embodiment, the first end-to-end connection sub-unit 150*a* may be physically engaged with the second end-to-end connection sub-unit 150*b* via complementary shapes thereof. Thus, the adjacent first guide-bodies 110 may be secured to each other. Likewise, the second end-to-end connection unit 150 to connect the adjacent second guide-bodies 120 to each other may include a third end-to-end connection sub-unit 150*a* disposed at one of the adjacent second guide-bodies 120, and a fourth end-to-end connection sub-unit 150*b* disposed at the other of the adjacent second guide-bodies 120. In one embodiment, the third end-to-end connection sub-unit 150*a* may be physically engaged with the fourth end-to-end connection sub-unit 150*b* via complementary shapes thereof. Thus, the adjacent second guide-bodies 120 may be secured to each other.

In one embodiment, the first end-to-end connection unit 150 may include first adjacent plates 151 disposed on facing ends of the adjacent first guide-bodies 110 respectively, wherein each of the first adjacent plates 151 protrudes laterally outwardly beyond each of the adjacent first guide-bodies 110; fixing ribs 152*a* and 152*b* disposed on top ends of the first adjacent plates 151 respectively to secure the adjacent first guide-bodies 110 to each other; a first set of vertically arranged first fixing holes 153 defined in the protruded portion of one of the first adjacent plate 151; a second set of vertically arranged first fixing holes 153 defined in the protruded portion of the other of the first adjacent plate 151, wherein the first and second sets of first fixing holes 153 position-correspond to each other, wherein the first and second sets of first fixing holes 153 are commonly passed through by a plurality of fasteners; a first set of vertically arranged first support ribs 154 respectively extending in a rounded manner from one of the first adjacent plates 151 along the outer face of one of the adjacent first guide-bodies 110; and a second set of vertically arranged first support ribs 154 respectively extending in a rounded manner from the other of the first adjacent plates 151 along the outer face of the other of the adjacent first guide-bodies 110. Likewise, the second end-to-end connection unit 150 may include second adjacent plates 151 disposed on facing ends of the adjacent second guide-bodies 120 respectively, wherein each of the second adjacent plates 151 protrudes laterally outwardly beyond each of the adjacent second guide-bodies 120; fixing ribs 152*a* and 152*b* disposed on top ends of the second adjacent plates 151 respectively to secure the adjacent second guide-bodies 120 to each other; a first set of vertically arranged second fixing holes 153 defined in the protruded portion of one of the second adjacent plates 151; a second set of vertically arranged second fixing holes 153 defined in the protruded portion of the other of the second adjacent plates 151, wherein the first and second sets of second fixing holes 153 position-correspond to each other, wherein the first and second sets of second fixing holes 153 are commonly passed through by a plurality of fasteners; a first set of vertically arranged second support ribs 154 respectively extending in a rounded manner from one of the second adjacent plates 151 along the outer face of one of the adjacent second guide-bodies 120; and a second set of vertically arranged second support ribs 154 respectively extending in a rounded manner from the other of the second adjacent plates 151 along the outer face of the other of the adjacent second guide-bodies 120.

In one embodiment, the fixing ribs may include a first fixing rib 152*a* and a second fixing rib 152*b*. The first end-to-end connection unit 150 to connect the adjacent first guide-bodies 110 to each other may include a first end-to-end connection sub-unit 150*a* disposed at one of the adjacent first guide-bodies 110, and a second end-to-end connection sub-unit 150*b* disposed at the other of the adjacent first guide-bodies 110. In one embodiment, the first end-to-end connection sub-unit 150*a* may include the first fixing rib 152*a* while the second end-to-end connection sub-unit 150*b* may include the second fixing rib 152*b*. Likewise, The second end-to-end connection unit 150 to connect the adjacent second guide-bodies 120 to each other may include a third end-to-end connection sub-unit 150*a* disposed at one of the adjacent second guide-bodies 120, and a fourth end-to-end connection sub-unit 150*b* disposed at the other of the adjacent second guide-bodies 120. In one embodiment, the third end-to-end connection sub-unit 150*a* may include the first fixing rib 152*a* while the fourth end-to-end connection sub-unit 150*b* may include the second fixing rib 152*b*.

In one embodiment, the first fixing rib 152*a* may be configured to allow level-alignment between the facing ends of the adjacent first guide-bodies 110 and/or level-alignment between the facing ends of the adjacent second guide-bodies 120. Further, the second fixing rib 152*b* may be shaped to an inverse L shape having a vertical portion and a horizontal portion. In this connection, the second fixing rib 152*b* may be disposed at one of the adjacent plates 151. The vertical portion thereof may be engaged with a hole defined in a top portion of the other of the adjacent first guide-bodies 110 or the other of the adjacent second guide-bodies 120. In this way, via the first fixing rib 152*a*, the level-alignment between the facing ends of the adjacent first guide-bodies 110 and/or the level-alignment between the facing ends of the adjacent second guide-bodies 120 may be achieved. In this state, via the second fixing rib 152*b*, the adjacent first guide-bodies 110 and/or the adjacent second guide-bodies 120 may be secured to each other.

As described above, each of the first adjacent plates 151 protrudes laterally outwardly beyond each of the adjacent first guide-bodies 110. Thus, the first set of vertically arranged first fixing holes 153 may be defined in the protruded portion of one of the first adjacent plate 151. The second set of vertically arranged first fixing holes 153 *m* may be defined in the protruded portion of the other of the first adjacent plates 151. The first set of vertically arranged first support ribs 154 may respectively extend in a rounded manner from one of the first adjacent plates 151 along the outer face of one of the adjacent first guide-bodies 110. The second set of vertically arranged first support ribs 154 may respectively extends in a rounded manner from the other of the first adjacent plates 151 along the outer face of the other of the adjacent first guide-bodies 110. Likewise, each of the second adjacent plates 151 protrudes laterally outwardly beyond each of the adjacent second guide-bodies 120. Thus, the first set of vertically arranged second fixing holes 153 may be defined in the protruded portion of one of the second adjacent plates 151. The second set of vertically arranged second fixing holes 153 *m* may be defined in the protruded portion of the other of the second adjacent plates 151. The first set of vertically arranged second support ribs 154 may respectively extend in a rounded manner from one of the second adjacent plates 151 along the outer face of one of the adjacent second guide-bodies 120. The second set of vertically arranged second support ribs 154 may respectively extends in a rounded manner from the other of the second adjacent plates 151 along the outer face of the other of the adjacent second guide-bodies 120.

In this connection, the first and second sets of the first fixing holes 153 may position-correspond to each other. The first and second sets of first fixing holes 153 are commonly passed through by a plurality of first fasteners respectively. In one example, the first fastener may be embodied as a bolt 40 as shown in FIG. 3A. Likewise, the first and second sets of the second fixing holes 153 may position-correspond to each other. The first and second sets of second fixing holes 153 are commonly passed through by a plurality of second fasteners respectively. In one example, the second fastener may be embodied as a bolt 40 as shown in FIG. 3A. In one embodiment, each of the vertically arranged first support ribs 154 may extend in a rounded manner from the first plate 151 along the outer face of the first guide-body 110 to a peak line of the first guide-body 110. Likewise, each of the vertically arranged second support ribs 154 may extend in a rounded manner from the second plate 151 along the outer face of the second guide-body 130 to a peak line of the second guide-body 120.

Moreover, the present casing guide assembly 100 may have a first recess portion 121 recessed from the first inner faces of the adjacent first guide-bodies 110 at a boundary region between the adjacent first guide-bodies 110. An inner end of the first plate 151 extends inwardly through the first recess portion 121 into the casing-accommodation space. The extension of the first plate 151 extending inwardly through the first recess portion 121 into the casing-accommodation space may act as a first inner fixing portion 155. Likewise, the present casing guide assembly 100 may have a second recess portion 122 recessed from the second inner faces of the adjacent second guide-bodies 120 at a boundary region between the adjacent second guide-bodies 120. An inner end of the second plate 151 extends inwardly through the second recess portion 122 into the casing-accommodation space. The extension of the second plate 151 extending inwardly through the second recess portion 122 into the casing-accommodation space may act as a second inner fixing portion 155. In one embodiment, the first recess portion 121 may include upper and lower first recess portions 121 vertically spaced from each other. The second recess portion 1212 may include upper and lower second recess portions 122 vertically spaced from each other. In this connection, in order to allow further securement between the adjacent first guide-bodies 110, a first inner fastener 40 (e.g., a bolt) may be engaged into an inner hole defined in the first inner fixing portion 155 while a first outer fastener may be engaged into an outer hole defined in the outwardly protruded portion of the first plate 151. Likewise, in order to allow further securement between the adjacent second guide-bodies 120, a second inner fastener 40 (e.g., a bolt) may be engaged in an inner hole defined in the second inner fixing portion 155 while a second outer fastener may be engaged into an outer hole defined in the outwardly protruded portion of the second plate 151.

In one embodiment, the first recess portion 121 may be formed by a combination of first and second recess sub-portions formed at the facing ends of the adjacent first guide-bodies 110 respectively when the adjacent first guide-bodies 110 are secured to each other in an end-to-end manner. In this connection, the first recess portion 121 may have a planar outer end face. Each of the first and second recess sub-portions defines a half of the first recess portion 121. Likewise, the second recess portion 122 may be formed by a combination of third and fourth recess sub-portions formed at the facing ends of the adjacent second guide-bodies 120 respectively when the adjacent second guide-bodies 120 are secured to each other in an end-to-end manner. In this connection, the second recess portion 122 may have a planar outer end face. Each of the third and fourth recess sub-portions defines a half of the second recess portion 121.

Each of the first and second guide-bodies 110 and 120 may have a uniform thickness t along the length direction thereof. The first guide-body 110 may have the first inner face configured in a shape thereof such that the plurality of the first concave-rounded vertically-extended portions 111 are arranged in the length-direction thereof. The second guide-body 120 may have the second inner face configured in a shape thereof such that the plurality of second concave-rounded vertically-extended portions 121 are arranged in the length-direction and are connected to one another. Further, in one embodiment, the first outer face of the first body 110 is configured in a shape thereof such that a plurality of first convex-rounded vertically-extended portions are arranged in the length-direction and are connected to one another. The second outer face of the second body 120 is configured in a shape thereof such that a plurality of second convex-rounded vertically-extended portions are arranged in the length-direction and are connected to one another. In this connection, the plurality of the first concave-rounded vertically-extended portions 111 may position-correspond to the plurality of first convex-rounded vertically-extended portions respectively. The plurality of the second concave-rounded vertically-extended portions 112 may position-correspond to the plurality of second convex-rounded vertically-extended portions respectively. In one example, each of the concave-rounded vertically-extended portions 111 and 121 may have a semi-circular shape as viewed from a top.

The plurality of the first concave-rounded vertically-extended portions 111 of the first body 110 may position-correspond to and face away the plurality of the second concave-rounded vertically-extended portions 121 respectively to define the plurality of the vertical casing-accommodation cylindrical spaces 100*a* therebetween respectively. Each vertical casing-accommodation cylindrical space 100*a* may shape-correspond to the cylindrical casing. Each of the vertical casing-accommodation cylindrical spaces 100*a* may have a substantially circular shape as viewed from a top. In this way, the plurality of the cylindrical casings 10 may be sequentially guided and inserted into the plurality of the vertical casing accommodation spaces 100*a* respectively.

Referring to FIG. 3A to FIG. 5, the at least one first coupling unit 130 may be configured to couple the first and second guide-bodies 110 and 120 to each other at the first and second top faces 110*a* and 120*a* thereof in a state when the first and second guide-bodies 110 and 120 face away from each other. The first coupling unit 130 may act to fix positions of the first and second guide-bodies 110 and 120 and a spacing therebetweeen. Thus, this may maintain the vertical casing accommodation space 100*a* to have a desired shape, thereby to improve production efficiency of the continuous-pile type sheathing wall.

The first coupling unit 130 includes first and second L-shaped fixing members 131 fixed to the first and second top faces of the first and second guide-bodies 110 and 120 respectively; and an upper connection member 135 in a form of an elongate round bar extending between and fixed to the first and second fixing members 131. The first coupling unit 130 may extend along a smallest spacing line between the first and second inner faces of the first and second guide-bodies 110 and 120. For example, the first coupling unit 130 may extend along a smallest spacing line between the first and second concave-rounded vertically-extended portions 111 and 121 of the first and second guide-bodies 110 and 120. To the contrary, the second coupling unit 140 may extend along a largest spacing line between the first and second inner faces of the first and second guide-bodies 110 and 120. For example, the second coupling unit 140 may extend along a largest spacing line between the first and second concave-rounded vertically-extended portions 111 and 121 of the first and second guide-bodies 110 and 120. This is shown in FIG. 4.

Each of the first and second fixing members 131 may include a horizontal portion 132 in contact with each of the first and second top faces of the first and second guide-bodies 110 and 120; a vertical portion 133 extending vertically from the horizontal portion 132 and having a through-hole 133*a* defined therein; and lateral inclined support portions 134 inclindedly connecting the horizontal portion 132 and the vertical portion 133 to each other.

In one embodiment, the horizontal portion 132 may be secured to each of the first and second guide-bodies 110 and 120 by bolting or welding. The vertical portion 133 may be integral with the horizontal portion 132 or may extend from the horizontal portion 132 via a hinge. The through-hole 133*a* is formed in the middle of the vertical portion 133. One of the lateral inclined support portions 134 extends between one of opposing lateral sides of the vertical portion 133 and one of opposing lateral sides of the horizontal portion 132 while the other of the lateral inclined support portions 134 extends between the other of the opposing lateral sides of the vertical portion 133 and the other of the opposing lateral sides of the horizontal portion 132. In this way, the lateral inclined support portions 134 may support the vertical portion 133.

The first and second fixing members 131 may be secured to the first and second guide-bodies 110 and 120 respectively. The upper connection member 135 may extend between and be secured to the first and second fixing members 131. Each of the horizontal portions 132 of the first and second fixing members 131 may extend inwardly relative to each vertical portion 133. That is, the horizontal portions 132 of the first and second fixing members 131 may face away each other. Thus, each of the vertical portions 133 of the first and second fixing members 131 may face toward each of the first and second outer faces of the first and second guide-bodies 110 and 120.

A thread 136 may formed on an outer face of each of opposing end portions of the upper connection member 135. Each end portion of the upper connection member 135 may be inserted into the through-hole 133*a* defined in each of the vertical portions 133 of the first and second fixing members 131. Then, each end portion of the upper connection member 135 may be fixed to each of the vertical portions 133 of the first and second fixing members 131 via an inner nut 137 and an outer nut 137. Each vertical portion 133 is interposed between the outer nut 137 and the inner nut 137 which tightly fasten the vertical portion 133. In one example, an inner thread complementary to the thread 136 provided on the upper connection member 135 may be formed on an inner side of the through-hole portion. As a result, the upper connection member 135 may be more securely fixed to the first and second fixing members 131 via the screw coupling.

FIG. 6A is a cross-sectional view taken along a line A-A of FIG. 2. FIG. 6B is a view schematically showing an example using a anchoring-bar guide channel shown in FIG. 6A. FIG. 7 is a cross-sectional view taken along a line B-B of FIG. 2.

Referring to FIG. 6A to FIG. 7, the casing guide assembly 100 has the vertical casing accommodation space 100*a* receiving the cylindrical casing 10. The vertical casing accommodation space 100*a* may be defined between the first and second guide-bodies 110 and 120 which are spaced from each other.

Each of the first and second guide-bodies 110 and 120 has an empty space at least partially formed therein. First and second anchoring-bar guide channels 21 may vertically pass through the first and second guide-bodies 110 and 120 respectively. Each of the top face portions of the first and second guide-bodies 110 and 120 has a fluid hole 31 defined therein for introducing water into the empty space and an anchoring-bar receiving hole defined therein communicating with each of the first and second anchoring-bar guide channels 21. There are a pipe cover 20 and a fluid hole cover 30. The former covers the opened end of each of the first and second anchoring-bar guide channels 21. The latter covers the fluid hole 31.

After the first and second guide-bodies 110 and 120 are installed, fluid such as water flows through the fluid hole 31 into the empty space in each of the first and second guide-bodies 110 and 120. In this way, movement of the first and second guide-bodies 110 and 120 may be suppressed by filling the water into the first and second guide-bodies 110 and 120. For example, by placing the first and second guide-bodies 110 and 120 on the ground and injecting water into the first and second guide-bodies 110 and 120 through each fluid hole 31, the first and second guide-bodies 110 and 120 are increased in weight, thereby preventing their movement. In one embodiment as shown in FIG. 6B, each of the first and second anchoring-bar guide channels 21 may penetrate vertically from the top face to the bottom face of each of the first and second guide-bodies 110 and 120. Thus, an anchoring-bar such as a micro-pile, a soil-nailing structure, or an anchor bar can be inserted through each of the first and second anchoring-bar guide channels 21 into the ground g. This ensures that the first and second guide-bodies 110 and 120 are securely fixed to the ground g, thereby preventing movement thereof during a construction process thereof. In one embodiment, after plural hole are drilled into the ground g under the first and second guide-bodies 110 and 120, plural micro-piles, soil-nailing structures, or anchor bars are inserted into the first and second guide-bodies 110 and 120 and then are grouted to the ground through the plural holes respectively. This allows easy control of intervals between the anchoring bars. However, the present invention is not limited thereto. That is, it may dispense with the anchoring-bar.

FIG. 8A is a cross-sectional view taken along a line C-C of FIG. 2. FIG. 8B is a cross-sectional view taken along a line D-D of FIG. 2. FIG. 9 is a schematic illustration of a second coupling unit according to an embodiment of the present invention. FIG. 10 is a perspective view of the second coupling unit of FIG. 9. FIG. 11 is a view illustrating an engaged state of the second coupling unit of FIG. 9. FIG. 12 is a view illustrating an unengaged state of the second coupling unit of FIG. 9.

Referring to FIG. 8 to FIG. 12, the guide assembly 100 for guiding the casing used in forming the sheathing wall in a ground has the plural of the vertical casing accommodation space 100*a* defined between the first and second guide-bodies 110 and 120 spaced from each other. The guide assembly 100 for guiding the casing includes the first coupling unit 130 to couple the first and second guide-bodies 110 and 120 to each other at the top faces thereof. The guide assembly 100 for guiding the casing includes the second coupling unit 140 to couple the first and second guide-bodies 110 and 120 to each other at lower positions of the inner faces thereof. Using the first and second coupling units 130 and 140, the first and second guide-bodies 110 and 120 spaced from each other are secured to each other.

In one embodiment, the first coupling unit 130 extends over the top faces of the first and second guide-bodies 110 and 120. Therefore, the horizontal alignment between the first and second guide-bodies 110 and 120 may be visually confirmed and, otherwise, the horizontal alignment may be adjusted. In addition, the second coupling unit 140 may allow firm securement between the lower portions of the first and second guide-bodies 110 and 120, since the lower portions of the first and second guide-bodies 110 and 120 are not secured to each other by the first coupling unit 130. Thereby, even when the heights of the first and second guide-bodies 110 and 120 increase, the overall shape of the vertical accommodation space 100*a* may be maintained to have the desired shape. Thus, the cylindrical casing 10 can be easily inserted into the vertical casing accommodation space 100*a*.

The second coupling unit 140 includes first and second box-accommodation recesses 142 defined inwardly in the inner face portion of the first and second guide-bodies 110 and 120 respectively; first and second coupling boxes 141 inserted into the first and second box-accommodation recesses 142 respectively; and a lower connection member 143 in a form of a round elongate bar inserted through and secured to the first and second coupling boxes 141. Each of the first and second box-accommodation recesses 142 has a shape corresponding to a shape of each of the first and second coupling boxes 141. Each coupling box 141 may be inserted into each box-accommodation recess 142 and then stably fixed to each of the first and second bodies 110 and 120 using a separate fastening member or by welding.

The coupling box 141 may be hollow. Each of the first and second coupling boxes 141 may have an opening 141*a* and 141*b* defined therein. The lower connection member 143 may be inserted into the opening 141*a* and 141*b*. The opening 141*a* and 141*b* includes a circular opening 141*a* and an elongate opening 141*b* communicating with the circular opening 141*a* and extending downwardly from the circular opening 141*a*.

The lower connection member 143 includes a circular-rounded elongate body 143*a*, and first and second heads 143*b* disposed at both opposing ends of the circular-rounded elongate body 143*a* respectively. Each of the first and second heads 143*b* has a diameter b1 greater than a diameter b2 of the circular-rounded elongate body 143*a*. The circular opening 141*a* has a diameter a1 larger than a diameter b2 of the circular-round elongated body 143*a* of the lower connection member 143. The width a2 of the elongate opening 141*b* is substantially equal to the diameter b2 of the circular-rounded elongate body 143*a* of the lower connection member 143. The lower end of the elongate opening 141*b* may be formed in a semicircular shape having a diameter substantially equal to the diameter b2 of the circular-round elongate body 143*a* of the lower connection member 143.

The guide assembly 100 may further include first and second box covers 144 to block the first and second coupling boxes 141 respectively inserted into the first and second box-accommodation recesses 142. For example, each of the first and second box covers 144 may be made of plastic or elastic rubber. The first and second box covers 144 block the first and second openings 141*a* and 141*b*, respectively, when the second coupling unit 140 is in an unengaged state. The first and second box covers 144 are then secured to the first and second bodies 110, 120, respectively, with an adhesive tape 145. Thus, the openings 141*a* and 141*b* formed in the coupling box 141 may be hermetically sealed. Accordingly, it is possible to prevent foreign materials from flowing into the coupling box 141 through the openings 141*a* and 141*b*.

Hereinafter, another embodiment of the present invention will be described with reference to FIGS. 13 to 26. Except for contents to be described later, contents similar to those described in the embodiment described in FIGS. 1 to 12 will not be described in detail.

FIG. 13 is a schematic view illustrating a guide assembly for guiding a casing in forming a sheathing wall in a ground according to another embodiment of the present invention.

Referring to FIG. 13, a guide assembly for guiding a casing in forming a sheathing wall in a ground according to another embodiment of the present invention includes first and second guide-bodies 210. Each of the first and second guide-bodies 210 is configured in a shape such that concave-rounded vertically-extended portions 211 are arranged in a length direction and are connected to each other. The concave-rounded vertically-extended portions 211 of the first and second guide-bodies 210 define a plurality of vertical casing-accommodation cylindrical spaces therebetween respectively, wherein each vertical casing-accommodation cylindrical space shape-corresponds to the cylindrical casing. Each of the plurality of vertical casing-accommodation cylindrical spaces receives each casing 11.

In this embodiment, one or more guide ribs 12 protrude from an outer face of the casing 11. In each of the concave-rounded vertically-extended portions 211 of each of the first and second guide-bodies 210, one or more guide grooves 212 and 213 are formed. The guide ribs 12 are inserted into one or more guide grooves 212 and 213 respectively. For example, each of the guide ribs 12 includes a projection. Each of the guide grooves includes a vertical guide groove 212 extending vertically from a top end to a lower portion of each of the concave-rounded vertically-extended portions 211, and a horizontal guide groove 213 horizontally extending from a lower end of the vertical guide groove 212 by a first length y3. Accordingly, the guide groove 212 and 213 may be L-shaped. The guide ribs 12 may be provided on the outer face of the casing 11 at a lower or upper portion thereof. The present invention is not limited thereto and, thus, various modifications are possible.

A width y1 of the vertical guide grooves 212 is equal to a width y2 of the horizontal guide groove 213. A width v of each of the guide ribs 12 is substantially equal to the width y1 of the vertical guide grooves 212 and the width y2 of the horizontal guide groove 213. On the other hand, the first length y3 may be longer than the width v of each of the guide ribs 12.

The casing 11 is inserted into the vertical casing-accommodation space defined between the first and second guide-bodies 210. In this connection, the guide ribs 12 provided on the outer face of the casing 11 are inserted into the guide grooves 212 and 213 respectively. This allows a stable guide of the casing 11 into the vertical casing-accommodation space. For example, the casing 11 may be guided by the vertical guide groove 212 so that the casing 11 is inserted in a perpendicular manner to the ground face. By rotating the casing 11 clockwise or counterclockwise after the casing 11 is fully inserted downwardly, each guide rib 12 is moved from each vertical guide groove 212 to each horizontal guide groove 213 so that the casing 11 is fixed in the vertical casing-accommodation space.

FIG. 14 is a top view of a guide assembly for guiding a casing used in forming a sheathing wall in a ground, wherein the guide assembly extends at an angle of 90 degrees, according to one embodiment of the present invention. FIG. 15 is a view schematically showing a top face of the assembly in FIG. 14. FIG. 16 is a sectional view of the assembly in FIG. 14. FIG. 17 is a perspective view of the assembly in FIG. 14.

Referring to FIG. 14 to FIG. 17, the guide assembly 400 for guiding a casing used in forming a sheathing wall in a ground includes first and second guide-bodies 410 and 420. Each of the first and second guide-bodies 410 and 420 is configured in a shape such that concave-rounded vertically-extended portions are arranged in a length direction and are connected to each other. The concave-rounded vertically-extended portions of the first and second guide-bodies 410 and 420 define a plurality of vertical casing-accommodation cylindrical spaces 400*a* therebetween respectively. Each of the plurality of vertical casing-accommodation cylindrical spaces 400*a* receives each casing 11. In this embodiment, the assembly includes at least one first coupling unit 430 configured to couple the first and second guide-bodies 410 and 420 to each other at the first and second top faces thereof.

The plurality of vertical casing-accommodation cylindrical spaces 400*a* communicates with each other. The plurality of vertical casing-accommodation cylindrical spaces 400*a* may extend in a length direction of the assembly. In this embodiment, each of the first and second guide-bodies 410 and 420 may be plural. The number of the first and second guide-bodies 410 and 420 may depend on a dimension of a foundation trench and a dimension of the continuous-pile type sheathing wall. The plurality of the first guide-bodies 410 may be coupled to each other, while the plurality of the second guide-bodies 420 may be coupled to each other.

In this connection, the guide assembly 400 includes a first end-to-end connection unit 450 connecting adjacent first guide-bodies 410 to each other at facing ends thereof, and a second end-to-end connection unit 450 connecting adjacent second guide-bodies 420 to each other at facing ends thereof. The first end-to-end connection unit 450 has the same configuration as that of the first end-to-end connection unit 150. The second end-to-end connection unit 450 has the same configuration as that of the second end-to-end connection unit 150.

More specifically, the first end-to-end connection unit 450 may include first adjacent plates 451 disposed on facing ends of the adjacent first guide-bodies 410 respectively, wherein each of the first adjacent plates 451 protrudes laterally outwardly beyond each of the adjacent first guide-bodies 410; fixing ribs 452*a* and 452*b* disposed on top ends of the first adjacent plates 451 respectively to secure the adjacent first guide-bodies 410 to each other; a first set of vertically arranged first fixing holes 453 defined in the protruded portion of one of the first adjacent plate 451; a second set of vertically arranged first fixing holes 453 defined in the protruded portion of the other of the first adjacent plate 451, wherein the first and second sets of first fixing holes 453 position-correspond to each other, wherein the first and second sets of first fixing holes 453 are commonly passed through by a plurality of fasteners. Likewise, the second end-to-end connection unit 450 may include second adjacent plates 451 disposed on facing ends of the adjacent second guide-bodies 420 respectively, wherein each of the second adjacent plates 451 protrudes laterally outwardly beyond each of the adjacent second guide-bodies 420; fixing ribs 452*a* and 452*b* disposed on top ends of the second adjacent plates 451 respectively to secure the adjacent second guide-bodies 420 to each other; a first set of vertically arranged second fixing holes 453 defined in the protruded portion of one of the second adjacent plates 451; a second set of vertically arranged second fixing holes 453 defined in the protruded portion of the other of the second adjacent plates 451, wherein the first and second sets of second fixing holes 453 position-correspond to each other, wherein the first and second sets of second fixing holes 453 are commonly passed through by a plurality of fasteners. Moreover, the present casing guide assembly 400 may have a first recess portion 412 recessed from the first inner faces of the adjacent first guide-bodies 410 at a boundary region between the adjacent first guide-bodies 410. An inner end of the first plate 451 extends inwardly through the first recess portion 421 into the casing-accommodation space. The extension of the first plate 451 extending inwardly through the first recess portion 421 into the casing-accommodation space may act as a first inner fixing portion 455. Likewise, the present casing guide assembly 400 may have a second recess portion 422 recessed from the second inner faces of the adjacent second guide-bodies 420 at a boundary region between the adjacent second guide-bodies 420. An inner end of the second plate 451 extends inwardly through the second recess portion 422 into the casing-accommodation space. The extension of the second plate 451 extending inwardly through the second recess portion 422 into the casing-accommodation space may act as a second inner fixing portion 455. In this connection, in order to allow further securement between the adjacent first guide-bodies 410, a first inner fastener (e.g., a bolt) may be engaged into an inner hole defined in the first inner fixing portion 455 while a first outer fastener may be engaged into an outer hole defined in the outwardly protruded portion of the first plate 451. Likewise, in order to allow further securement between the adjacent second guide-bodies 420, a second inner fastener (e.g., a bolt) may be engaged in an inner hole defined in the second inner fixing portion 455 while a second outer fastener may be engaged into an outer hole defined in the outwardly protruded portion of the second plate 451.

In this embodiment, the casing guide assembly 400 includes a first end-to-end pivotal connection unit 460 configured to connect adjacent and spaced first guide-bodies 410 to each other at facing ends thereof in an end-to-end spaced manner, and a second end-to-end pivotal connection unit 460 configured to connect adjacent and spaced second guide-bodies 420 to each other at facing ends thereof in an end-to-end spaced manner.

The first end-to-end pivotal connection unit 460 includes adjacent and spaced first plates 461 coupled to the adjacent and spaced first guide-bodies 410 at facing ends thereof respectively; first adjacent and spaced coupling flanges, each flange configured to allow the coupling between each of the adjacent and spaced first plates 461 at each of inner ends thereof and each of adjacent and spaced first guide-bodies 410 at each of the inner faces thereof; a first hinge mechanism 463 coupled to each of the first adjacent and spaced coupling flanges to allow a pivotal movement of each of the first adjacent and spaced coupling flanges and thus a pivotal movement of each of the adjacent and spaced first guide-bodies 410; a first outer support 464 to connect the adjacent and spaced first guide-bodies 410 at facing ends of the outer faces thereof; a first connection bar 465 to connect the adjacent and spaced first guide-bodies 410 at facing ends of the top faces thereof. Likewise, The second end-to-end pivotal connection unit 460 includes adjacent and spaced second plates 461 coupled to the adjacent and spaced second guide-bodies 420 at facing ends thereof respectively; second adjacent and spaced coupling flanges, each flange configured to allow the coupling between each of the adjacent and spaced second plates 461 at each of inner ends thereof and each of adjacent and spaced second guide-bodies 420 at each of the inner faces thereof; a second hinge mechanism 463 coupled to each of the second adjacent and spaced coupling flanges to allow a pivotal movement of each of the second adjacent and spaced coupling flanges and thus a pivotal movement of each of the adjacent and spaced second guide-bodies 420; a second outer support 464 to connect the adjacent and spaced second guide-bodies 420 at facing ends of the outer faces thereof; a second connection bar 465 to connect the adjacent and spaced second guide-bodies 420 at facing ends of the top faces thereof.

In installation of the assembly, the adjacent and spaced first plates 461 coupled to the adjacent and spaced first guide-bodies 410 at facing ends thereof respectively may face away each other in a parallel manner. Then, the adjacent and spaced first plates 461 may be coupled to the adjacent and spaced first guide-bodies 410 at facing ends thereof respectively. Then, via the first hinge mechanism 463, a pivotal movement of each of the first adjacent and spaced coupling flanges and thus a pivotal movement of each of the adjacent and spaced first guide-bodies 410 may be executed by external forces. In this connection, an angular degree of the pivotal movement may depend on an angle of the curved corner of the present assembly. In this example as shown in FIG. 14, the angular degree of the pivotal movement is 90 degrees. Then, via the first outer support 464, a coupling between the adjacent and spaced first guide-bodies 410 at facing ends of the outer faces thereof may be realized. Then, via the first connection bar 465, a further coupling between the adjacent and spaced first guide-bodies 410 at facing ends of the top faces thereof may be realized. In this way, the number of the first guide-bodies 410 may be connected in series to each other in a curved manner. This may be equally applied to the second end-to-end pivotal connection unit 460 and the adjacent and spaced second guide-bodies 410. Thus, the number of the second guide-bodies 420 may be connected in series to each other in a curved manner.

The first hinge mechanism 463 allows the pivotal movement of each of the adjacent and spaced first guide-bodies 410 in a target curved degree. The second hinge mechanism 463 allows the pivotal movement of each of the adjacent and spaced second guide-bodies 420 in a target curved degree. Thus, the curvature of the curved portion of the elongate casing guide assembly may vary depending on the shape of the continuous-pile type sheathing wall.

In one embodiment, the adjacent first guide-bodies 410 or the adjacent second guide-bodies 420 may be connected to each other only via the end-to-end connection unit 450. However, in this case, the curved portion of the elongate casing guide assembly may not be realized. The adjacent first guide-bodies 410 or the adjacent second guide-bodies 420 may be connected to each other not only via the end-to-end connection unit 450 but also the end-to-end pivotal connection unit 460. In this case, the curved portion of the elongate casing guide assembly may be realized. Thus, the casing guide assembly 400 with the curved extension may be installed in the ground.

The casing guide assembly 400 can be controlled in an angle of the curved extension via the end-to-end pivotal connection unit 460. In addition, the combination of the end-to-end connection unit 450 and the end-to-end pivotal connection unit 460, the casing guide assembly 400 may have a great degree of freedom in an extension shape. For example, the angle of the curved extension of the casing guide assembly 400 may be 70, 90, 100 or 130 degrees.

FIG. 18A is a schematic view of a casing guide assembly according to one embodiment of the present invention. FIG. 18B is a view schematically showing a front face of the assembly in FIG. 18A.

Referring to FIG. 18A and FIG. 18B, the casing guide assembly 600*a* includes first and second guide-bodies 610*a* and 620*a* having the first and second inner faces respectively, each inner face being configured in a shape thereof such that a plurality of concave-rounded vertically-extended portions are arranged in the length-direction and are connected to one another. In this embodiment, the first and second guide-bodies 610*a* and 620*a* have the first and second outer faces respectively, each outer face being configured to be tilted outwardly as it goes downwardly. The outer face has a planar shape. More specifically, each of the first and second outer faces of the first and second guide-bodies 610*a* and 620*a* may be tilted such that a width of each of the first and second guide-bodies 610*a* and 620*a* gradually increases from a top to a bottom thereof. Each of the first and second inner faces of the first and second guide-bodies 610*a* and 620*a* has a lateral edge line perpendicular to the ground face. The configuration of this embodiment may allow the casing guide assembly 600*a* to rest on the ground face in a more stable manner.

FIG. 19A is a schematic view of a casing guide assembly according to one embodiment of the present invention. FIG. 19B is a view schematically showing a front face of the assembly in FIG. 19A.

Referring to FIG. 19A and FIG. 19B, the casing guide assembly 600*b* includes first and second guide-bodies 610*b* and 620*b* having the first and second inner faces respectively, each inner face being configured in a shape thereof such that a plurality of concave-rounded vertically-extended portions are arranged in the length-direction and are connected to one another. In this embodiment, the first and second guide-bodies 610*b* and 620*b* have the first and second outer faces respectively, each outer face being configured to be stepped outwardly in a middle level thereof.

More specifically, each of the first and second outer faces of the first and second guide-bodies 610*a* and 620*a* may be stepped such that a width of a bottom of each of the first and second guide-bodies 610*a* and 620*a* is larger than a width of a top of each of the first and second guide-bodies 610*a* and 620*a*. Each of the first and second inner faces of the first and second guide-bodies 610*a* and 620*a* has a lateral edge line perpendicular to the ground face. The configuration of this embodiment may allow the casing guide assembly 600*a* to rest on the ground face in a more stable manner.

FIG. 20A is a schematic view of a casing guide assembly according to one embodiment of the present invention. FIG. 20B is a view schematically showing a front face of the assembly in FIG. 20A.

Referring to FIG. 20A and FIG. 20B, the casing guide assembly 600*c* includes first and second guide-bodies 610*c* and 620*c* having the first and second inner faces respectively, each inner face being configured in a shape thereof such that a plurality of concave-rounded vertically-extended portions are arranged in the length-direction and are connected to one another. In this embodiment, the first and second guide-bodies 610*c* and 620*c* have the first and second outer faces respectively, each outer face being configured to be tilted outwardly downwardly from a top level to a middle level thereof and to extend perpendicularly to each top face of the bodies 610*c* and 620*c* from a middle level thereof to a bottom level thereof such that a width of a bottom level of each of the first and second guide-bodies 610*a* and 620*a* is equal to a width of a middle level thereof and is larger than a width of a top level of each of the first and second guide-bodies 610*a* and 620*a*. Each of the first and second inner faces of the first and second guide-bodies 610*a* and 620*a* has a lateral edge line perpendicular to the ground face. The configuration of this embodiment may allow the casing guide assembly 600*a* to rest on the ground face in a more stable manner.

FIG. 21A is a schematic view of a casing guide assembly according to one embodiment of the present invention. FIG. 21B is a view schematically showing a front face of the assembly in FIG. 21A.

Referring to FIG. 21A and FIG. 21B, the casing guide assembly 600*d* includes first and second guide-bodies 610*d* and 620*d* having the first and second inner faces respectively, each inner face being configured in a shape thereof such that a plurality of concave-rounded vertically-extended portions are arranged in the length-direction and are connected to one another. In this embodiment, the first and second guide-bodies 610*d* and 620*d* have the first and second outer faces respectively, each outer face being configured in a shape thereof such that a plurality of convex-rounded vertically-extended portions are arranged in the length-direction and are connected to one another. In this embodiment, each of the convex-rounded vertically-extended portions has a larger curvature than each of the concave-rounded vertically-extended portions. In one embodiment, one convex-rounded vertical portion corresponds to at least two concave-rounded vertically-extended portions. In one example as shown in FIG. 21B, one convex-rounded vertical portion corresponds to two concave-rounded vertically-extended portions.

FIG. 22A is a schematic view of a casing guide assembly according to one embodiment of the present invention. FIG. 22B is a view schematically showing a front face of the assembly in FIG. 22A.

Referring to FIG. 22A and FIG. 22B, the casing guide assembly 600*e* includes first and second guide-bodies 610*e* and 620*e* having the first and second inner faces respectively, each inner face being configured in a shape thereof such that a plurality of concave-rounded vertically-extended portions are arranged in the length-direction and are connected to one another. In this embodiment, the first and second guide-bodies 610*e* and 620*e* have the first and second outer faces respectively, each outer face being configured in a shape thereof such that a plurality of convex-rounded vertically-extended portions are arranged in the length-direction and are connected to one another. In this embodiment, each of the convex-rounded vertically-extended portions has a larger curvature than each of the concave-rounded vertically-extended portions. In one embodiment, one convex-rounded vertical portion corresponds to at least three concave-rounded vertically-extended portions. In one example as shown in FIG. 22B, one convex-rounded vertical portion corresponds to three concave-rounded vertically-extended portions.

FIG. 23A is a schematic view of a casing guide assembly according to one embodiment of the present invention. FIG. 23B is a view schematically showing a front face of the assembly in FIG. 23A.

Referring to FIG. 23A and FIG. 23B, the casing guide assembly 600*f* includes first and second guide-bodies 610*f* and 620*f* having the first and second inner faces respectively, each inner face being configured in a shape thereof such that a plurality of concave-rounded vertically-extended portions are arranged in the length-direction and are connected to one another. In this embodiment, the first and second guide-bodies 610*e* and 620*e* have the first and second outer faces respectively, each outer face being configured in a shape thereof such that a plurality of convex-shaped triangular-cross-sectional prisms are arranged in the length-direction and are connected to one another. In one embodiment, one of the convex-shaped triangular-cross-sectional prisms corresponds to at least three concave-rounded vertically-extended portions. In one example as shown in FIG. 23B, one of the convex-shaped triangular-cross-sectional prisms corresponds to three concave-rounded vertically-extended portions.

Each of the convex-shaped triangular-cross-sectional prisms has an outer peak vertical edge. The outer peak vertical edge may be positioned at a center line between both opposing valley vertical portions of each of the convex-shaped triangular-cross-sectional prisms. Thus, when one of the convex-shaped triangular-cross-sectional prisms corresponds to the three concave-rounded vertically-extended portions as shown in FIG. 23B, the opposing valley vertical portions of each of the convex-shaped triangular-cross-sectional prisms may position-correspond to both vertical opposing ends of a connection of the three concave-rounded vertically-extended portions. In other words, a width of each of first and second guide-bodies 610*e* and 620*e* decreases gradually from the outer peak vertical edge toward the opposing valley vertical portions of each of the convex-shaped triangular-cross-sectional prisms.

FIG. 24 is a schematic illustration of a second coupling unit according to one embodiment of the present invention. FIG. 25 is a sectional view taken along a line E-E in FIG. 14.

In this embodiment, the casing guide assembly 800 includes first and second guide-bodies 810 facing away each other. The casing guide assembly 800 includes at least one second coupling unit 810 configured to couple the first and second guide-bodies 810 to each other at lower positions of the first and second inner faces thereof.

The second coupling unit 840 includes first and second box-accommodation recesses defined inwardly in the inner face portion of the first and second guide-bodies 810 and 820 respectively; first and second coupling boxes 841 inserted into the first and second box-accommodation recesses 842 respectively; and a lower connection member (not shown) in a form of a round elongate bar inserted through and secured to the first and second coupling boxes 841. Each coupling box 841 may be inserted into each box-accommodation recess 842 and then stably fixed to each of the first and second bodies 810 and 820 using a separate fastening member or by welding.

The coupling box 841 may be hollow. Each of the first and second coupling boxes 841 may have an opening 841*a* and 841*b* defined therein. The lower connection member may be inserted into the opening 841*a* and 841*b*. The opening 841*a* and 841*b* includes a circular opening 841*a* and an elongate opening 841*b* communicating with the circular opening 841*a* and extending downwardly from the circular opening 841*a*.

The guide assembly 800 may further include first and second box covers 844 to block the first and second coupling boxes 841 respectively inserted into the first and second box-accommodation recesses. The first and second box covers 844 block the first and second openings 841*a* respectively, when the second coupling unit 840 is in an unengaged state. Each of the first and second box covers 844 has a shape corresponding to each of the first and second openings 841*a*.

That is, each of the first and second box covers 844 has a circular-shaped portion and an elongate portion 841*b* extending downwardly from the circular portion. The circular-shaped portion of the each of the first and second box covers 844 has an upper groove, through which a bar is inserted, thereby to allow detachment of the box cover from the opening. Each of the first and second box covers 844 has an inner inserted portion 844*b* and an outer non-inserted shoulder 844*a* integral with the inner portion, wherein when the second coupling unit is in an unengaged state, the inner portion 844*b* is inserted into the opening of each of the first and second boxes 844, and the outer shoulder 844*a* is out of the opening. Then, the first and second box covers 844 are then secured to the first and second bodies 810, 820, respectively, with an adhesive tape 845. Thus, the openings 841*a* and 841*b* formed in the coupling box 841 may be hermetically sealed. Accordingly, it is possible to prevent foreign materials form flowing into the coupling box 841 through the openings 841*a* and 841*b*.

FIG. 26 is a flowchart illustrating a method for forming a sheathing wall in a ground using the guide assembly according to one of the present invention.

Referring to FIG. 26, a method for forming a sheathing wall in a ground using the guide assembly may include placing a first guide-body having first inner and outer vertical faces and first top and bottom horizontal faces extending in a length-direction thereof, wherein the first inner face is configured such that a plurality of first concave-rounded vertically-extended portions are arranged in a shape thereof the length-direction and are connected to one another; placing a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face; securing the first and second guide-bodies to each other; inserting a hollow casing between and into the first and second inner faces of the first and second guide-bodies; and filling and solidifying a pile-forming material into the casing. In one embodiment, the first outer face of the first body is configured in a shape thereof such that a plurality of first convex-rounded vertically-extended portions are arranged in the length-direction and are connected to one another. The second outer face of the second body is configured in a shape thereof such that a plurality of second convex-rounded vertically-extended portions are arranged in the length-direction and are connected to one another.

The operations of placing the first and second guide-bodies include manufacturing the first and second guide-bodies respectively. In order to manufacture the first and second guide-bodies, the inner face portion of each of the first body and second body may be embodied as a sequential connection between a plurality of inner semi-circular hollow cylindrical steel tubes. The outer face portion of each of the first body and second body may be embodied as a sequential connection between a plurality of outer semi-circular hollow cylindrical steel tubes. The inner face portion is horizontally spaced from the outer face portion such that the plurality of inner semi-circular hollow cylindrical steel tubes position-correspond to the plurality of outer semi-circular hollow cylindrical steel tubes. The inner and outer faces are spaced from each other such that fluid such as water fills in therebetween. Thus, this may prevent movement of the first and second guide-bodies during installation thereof.

Prior to the operations of placing the first and second guide-bodies, the ground is drilled to form holes with a depth equal to the height of each of the first and second guide-bodies. Placing the first and second guide-bodies includes placing the first and second guide-bodies into the drilled holes respectively.

The operations of placing the first and second guide-bodies include spacing the plurality of first concave-rounded vertically-extended portions to the plurality of second concave-rounded vertically-extended portions from each other in a position-corresponding manner, thereby defining a plurality of vertical casing-accommodation cylindrical spaces therebetween respectively. The operation of securing the first and second guide-bodies to each other includes using at least one first coupling unit configured to couple the first and second guide-bodies to each other at the first and second top faces thereof.

The operation of securing the first and second guide-bodies to each other includes inserting first and second anchoring-bars through the first and second anchoring-bar guide channels into the ground and/or filling fluid such as water into the empty space defined in each of the first and second guide-bodies, thereby to suppress movement of the first and second guide-bodies.

In this connection, each of the first and second guide-bodies has an empty space at least partially formed therein. The first and second anchoring-bar guide channels vertically pass through the first and second guide-bodies respectively. Each of the top face portions of the first and second guide-bodies has a first hole defined therein for introducing water into the empty space; and a second hole defined therein communicating with each of the first and second anchoring-bar guide channels. The guide assembly has first and second covers, wherein the first cover blocks the first hole and the second cover blocks the second hole. Thus, an anchoring-bar such as a micro-pile, a soil-nailing structure, or an anchor bar can be inserted through each of the first and second anchoring-bar guide channels into the ground. This ensures that the first and second guide-bodies are securely fixed to the ground, thereby preventing movement thereof during a construction process thereof.

The operation of securing the first and second guide-bodies to each other includes using the first and/or second coupling units. The first coupling unit is configured to couple the first and second guide-bodies to each other at the first and second top faces thereof. The second coupling unit is configured to couple the first and second guide-bodies to each other at lower positions of the first and second inner faces thereof. By using the second coupling unit, vertical movement of the first and second guide-bodies may be prevented. Accordingly, even when the height of each of the first and second guide-bodies is greater than a predetermined height, the first and second guide-bodies may be easily secured to each other.

The second coupling unit includes first and second box-accommodation recesses defined at the lower positions of the first and second inner faces respectively; first and second coupling boxes inserted into the first and second box-accommodation recesses respectively; and a lower connection member in a form of an elongate bar inserted through and secured to the first and second coupling boxes. Each of the first and second coupling boxes has an opening defined therein, wherein the lower connection member is inserted into the opening. This allows coupling between the first and second guide-bodies to each other at lower positions of the first and second inner faces thereof.

Then, the hollow cylindrical casing is inserted between and into the first and second inner faces of the first and second guide-bodies. The casing may be hollowed in a target depth using an auger.

Then, the operation of filling and solidifying the pile-forming material into the hollow casing may be executed. In one example, the pile-forming material may be a concrete material. After the pile-forming material is solidified, the casing is removed from the first and second bodies. Further, when the concrete is used, a steel frame may be employed. To this end, after a steel guide is installed into the casing guide assembly, the steel frame may be inserted in the casing and the concrete may be poured into the casing.

As for the method for forming a sheathing wall in a ground using the guide assembly, the hinge mechanism allows the pivotal movement of each of the adjacent and spaced first and/or second guide-bodies in a target curved degree. Thus, the curvature of the curved portion of the elongate casing guide assembly may vary depending on the shape of the continuous-pile type sheathing wall. This curved portion may be realized using the end-to-end pivotal connection units including the hinge mechanism as described above with reference to FIG. 16 and FIG. 17.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," "one implementation," "an implementation," or similar language means that a particular feature, structure, or characteristic that is described in connection with the embodiment is included in at least one embodiment of the present disclosure. Thus, appearances of the phrases "in one embodiment," "in an embodiment," "one implementation," "an implementation," or similar language throughout this specification may, but do not necessarily, all refer to the same embodiment.

REFERENCE NUMERALS

100: casing guide assembly
110, 210, 310, 410, 510: first guide-body
120, 320, 420, 520: second guide-body
10, 11: casing
130: first coupling unit
140: second coupling unit
150: end-to-end connection unit

What is claimed is:

1. A guide assembly for guiding a cylindrical casing used in forming a sheathing wall in a ground, the assembly comprising:

a first guide-body having first inner and outer vertical faces and first top and bottom horizontal faces extending in a length-direction thereof, wherein the first inner face is configured in a shape thereof such that a plurality of first concave-rounded vertically-extended portions are arranged the length-direction and are connected to one another;

a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face;

at least one first coupling unit configured to couple the first and second guide-bodies to each other at the first and second top faces thereof; and at least one second coupling unit configured to couple the first and second guide-bodies to each other at lower positions of the first and second inner faces thereof, wherein the plurality of first concave-rounded vertically-extended portions position-correspond to the plurality of second concave-rounded vertically-extended portions respectively to define a plurality of vertical casing-accommodation cylindrical spaces therebetween respectively, wherein each vertical casing-accommodation cylindrical space shape-corresponds to the cylindrical casing, wherein the second coupling unit includes:

first and second box-accommodation recesses defined at the lower positions of the first and second inner faces respectively; and first and second coupling boxes inserted into the first and second box-accommodation recesses respectively.

2. The guide assembly of claim 1, wherein the second coupling unit further includes a lower connection member in a form of an elongate bar inserted through and secured to the first and second coupling boxes, wherein each of the first and second coupling boxes is hollow, wherein each of the first and second coupling boxes has an opening defined therein, wherein the lower connection member is inserted into the opening, wherein the opening includes a circular opening, and an elongate opening communicating with the circular opening and extending downwardly from the circular opening, wherein the lower connection member includes:

a elongate body with a circular cross-section; and first and second heads disposed at both opposing ends of the elongate body respectively, wherein each of the first and second heads has a diameter greater than a diameter of the elongate body, wherein the circular opening has a diameter larger than the diameter of the elongated body of the lower connection member, wherein the width of the elongate opening is substantially equal to the diameter of the elongate body of the lower connection member, wherein a lower end of the elongate opening is formed in a semicircular shape having a diameter substantially equal to the diameter of the elongate body of the lower connection member.

3. The guide assembly of claim 2, wherein the guide assembly further includes first and second box covers to cover the first and second coupling boxes respectively inserted into the first and second openings, wherein each of the first and second box covers has a groove defined in an upper portion thereof;

wherein each of the first and second box covers has an inner inserted head and an outer non-inserted shoulder integral with the inner inserted head, wherein when the second coupling unit is in an unengaged state, the inner head is inserted into the opening of each of the first and second boxes, and the outer shoulder is out of the opening.

4. The guide assembly of claim 1, wherein the first coupling unit includes:

first and second L-shaped fixing members fixed to the first and second top faces of the first and second guide-bodies respectively; and an upper connection member in a form of an circular-cross sectional elongate bar extending between and fixed to the first and second fixing members, wherein each of the first and second fixing members includes:

a horizontal portion in contact with each of the first and second top faces of the first and second guide-bodies;

a vertical portion extending vertically from the horizontal portion and having a through-hole defined therein; and lateral inclined support portions inclindedly connecting the horizontal portion and the vertical portion to each other, wherein each of the horizontal portions of the first and second fixing members extends inwardly relative to each vertical portion such that the horizontal portions of the first and second fixing members face away each other and the vertical portions of the first and second fixing members face toward the first and second outer faces of the first and second guide-bodies respectively, wherein an thread is formed on an outer face of each of opposing end portions of the upper connection member, wherein each end portion of the upper connection member is inserted into the through-hole defined in each of the vertical portions of the first and second fixing members, wherein each end portion of the upper connection member is fixed to each of the vertical portions via an inner nut and an outer nut threaded with the thread while each vertical portion is interposed between the outer nut and the inner nut which tightly fasten the vertical portion.

5. The guide assembly of claim 1, wherein the guide assembly includes a first end-to-end connection unit connecting adjacent first guide-bodies to each other at facing ends thereof, and a second end-to-end connection unit connecting adjacent second guide-bodies to each other at facing ends thereof, wherein the first end-to-end connection unit includes:

first adjacent plates disposed on facing ends of the adjacent first guide-bodies respectively, wherein each of the first adjacent plates protrudes laterally outwardly beyond each of the adjacent first guide-bodies;

fixing ribs disposed on top ends of the first adjacent plates respectively to secure the adjacent first guide-bodies to each other;

a first set of vertically arranged first fixing holes defined in the protruded portion of one of the first adjacent plates;

a second set of vertically arranged first fixing holes defined in the protruded portion of the other of the first adjacent plates, wherein the first and second sets of first fixing holes position-correspond to each other, wherein the first and second sets of first fixing holes are commonly passed through by a plurality of fasteners;

a first set of vertically arranged first support ribs respectively extending from one of the first adjacent plates along the outer face of one of the adjacent first guide-bodies; and a second set of vertically arranged first support ribs respectively extending in a from the other of the first adjacent plates along the outer face of the other of the adjacent first guide-bodies, wherein the second end-to-end connection unit includes:

second adjacent plates disposed on facing ends of the adjacent second guide-bodies respectively, wherein each of the second adjacent plates protrudes laterally outwardly beyond each of the adjacent second guide-bodies;

fixing ribs disposed on top ends of the second adjacent plates respectively to secure the adjacent second guide-bodies to each other;

a first set of vertically arranged second fixing holes defined in the protruded portion of one of the second adjacent plates;

a second set of vertically arranged second fixing holes defined in the protruded portion of the other of the second adjacent plates, wherein the first and second sets of second fixing holes position-correspond to each other, wherein the first and second sets of second fixing holes are commonly passed through by a plurality of fasteners;

a first set of vertically arranged second support ribs respectively extending from one of the second adjacent plates along the outer face of one of the adjacent second guide-bodies; and a second set of vertically arranged second support ribs respectively extending in a rounded manner from the other of the second adjacent plates along the outer face of the other of the adjacent second guide-bodies, wherein the adjacent first guide-bodies have a first recess portion recessed from the first inner faces of the adjacent first guide-bodies at a boundary region between the adjacent first guide-bodies, wherein an inner end of each of the first plates extends inwardly through the first recess portion into the casing-accommodation space, wherein the adjacent second guide-bodies have a second recess portion recessed from the second inner faces of the adjacent second guide-bodies at a boundary region between the adjacent second guide-bodies, wherein an inner end of each of the second plates extends inwardly through the second recess portion into the casing-accommodation space, wherein a first inner fastener is engaged into an inner hole defined in the inner end of each of the first plates while a first outer fastener is engaged into an outer hole defined in the outwardly protruded portion of the first plate, wherein a second inner fastener is engaged into an inner hole defined in the inner end of each of the second plates while a second outer fastener is engaged into an outer hole defined in the outwardly protruded portion of the second plate.

6. The guide assembly of claim 5, wherein the fixing ribs of each of the first and second end-to-end connection units include a first fixing rib and a second fixing rib, wherein the first fixing rib of the first end-to-end connection unit is configured to allow level-alignment between the facing ends of the adjacent first guide-bodies, wherein the first fixing rib of the second end-to-end connection unit is configured to allow level-alignment between the facing ends of the adjacent second guide-bodies, wherein the second fixing rib is shaped to an inverse L shape having a vertical portion and a horizontal portion, wherein the second fixing rib of the first end-to-end connection unit is disposed at one of the adjacent first plates, wherein the vertical portion thereof is engaged into a hole defined in a top portion of the other of the adjacent first guide-bodies, wherein the second fixing rib of the second end-to-end connection unit is disposed at one of the adjacent second plates, wherein the vertical portion thereof is engaged into a hole defined in a top portion of the other of the adjacent second guide-bodies.

7. The guide assembly of claim 1, wherein the casing guide assembly includes:

a first end-to-end pivotal connection unit configured to connect adjacent and spaced first guide-bodies to each other at facing ends thereof in an end-to-end spaced manner; and a second end-to-end pivotal connection unit configured to connect adjacent and spaced second guide-bodies to each other at facing ends thereof in an end-to-end spaced manner, wherein the first end-to-end pivotal connection unit includes:

adjacent and spaced first plates coupled to the adjacent and spaced first guide-bodies at facing ends thereof respectively;

first adjacent and spaced coupling flanges, each flange configured to allow the coupling between each of the adjacent and spaced first plates at each of inner ends thereof and each of adjacent and spaced first guide-bodies at each of the inner faces thereof;

a first hinge mechanism coupled to each of the first adjacent and spaced coupling flanges to allow a pivotal movement of each of the first adjacent and spaced coupling flanges and thus a pivotal movement of each of the adjacent and spaced first guide-bodies;

a first outer support to connect the adjacent and spaced first guide-bodies at facing ends of the outer faces thereof; and a first connection bar to connect the adjacent and spaced first guide-bodies at facing ends of the top faces thereof, wherein the second end-to-end pivotal connection unit includes:

adjacent and spaced second plates coupled to the adjacent and spaced second guide-bodies at facing ends thereof respectively;

second adjacent and spaced coupling flanges, each flange configured to allow the coupling between each of the adjacent and spaced second plates at each of inner ends thereof and each of adjacent and spaced second guide-bodies at each of the inner faces thereof;

a second hinge mechanism coupled to each of the second adjacent and spaced coupling flanges to allow a pivotal movement of each of the second adjacent and spaced coupling flanges and thus a pivotal movement of each of the adjacent and spaced second guide-bodies;

a second outer support to connect the adjacent and spaced second guide-bodies at facing ends of the outer faces thereof; and a second connection bar to connect the adjacent and spaced second guide-bodies at facing ends of the top faces thereof.

8. The guide assembly of claim 1, wherein each of the first and second guide-bodies has an empty space at least partially formed therein, wherein first and second anchoring-bar guide channels vertically pass through the first and second guide-bodies respectively, wherein each of the top face portions of the first and second guide-bodies has:

a first hole defined therein for introducing water into the empty space; and a second hole defined therein communicating with each of the first and second anchoring-bar guide channels, wherein the guide assembly has first and second covers, wherein the first cover blocks the first hole and the second cover blocks the second hole.

9. The guide assembly of claim 1, wherein one or more guide ribs protrude from an outer face of the casing, wherein one or more guide grooves are formed in each of the first and second concave-rounded vertically-extended portions, wherein the guide ribs are inserted and guided into one or more guide grooves respectively, wherein each of the guide ribs includes a projection, wherein each of the guide grooves includes:

a vertical guide groove extending vertically from a top end to a lower portion of each of the first and second concave-rounded vertically-extended portions; and a horizontal guide groove horizontally extending from a lower end of the vertical guide groove by a first length, wherein the vertical groove communicates with the horizontal groove, wherein a width of the vertical guide groove is substantially equal to a width of each of the guide ribs, wherein the first length is longer than the width of each of the guide ribs.

10. The guide assembly of claim 1, wherein the first and second guide-bodies have the first and second outer faces respectively, wherein each outer face has a tilted plane, wherein each of the first and second outer faces of the first and second guide-bodies is tilted such that a width of each of the first and second guide-bodies gradually increases from a top to a bottom thereof.

11. The guide assembly of claim 1, wherein the first and second guide-bodies have the first and second outer faces respectively, each outer face being configured to be stepped outwardly in a middle level thereof, wherein each of the first and second outer faces of the first and second guide-bodies may be stepped such that a width of a bottom of each of the first and second guide-bodies is larger than a width of a top of each of the first and second guide-bodies.

12. The guide assembly of claim 1, wherein the first and second guide-bodies have the first and second outer faces respectively, each outer face being configured to be tilted outwardly downwardly from a top level to a middle level thereof and extend perpendicularly to each top face of the bodies from a middle level thereof to a bottom level thereof such that a width of a bottom level of each of the first and second guide-bodies is equal to a width of a middle level thereof and is larger than a width of a top level of each of the first and second guide-bodies.

13. The guide assembly of claim 1, wherein the first and second guide-bodies have the first and second outer faces respectively, each outer face being configured in a shape thereof such that a plurality of convex-rounded vertically-extended portions are arranged in the length-direction and are connected to one another, wherein each of the convex-rounded vertically-extended portions has a larger curvature than each of the concave-rounded vertically-extended portions, wherein one convex-rounded vertical portion corresponds to at least two concave-rounded vertically-extended portions.

14. The guide assembly of claim 1, wherein the first and second guide-bodies have the first and second outer faces respectively, each outer face being configured in a shape thereof such that a plurality of convex-shaped triangular-cross-sectional prisms are arranged in the length-direction and are connected to one another, and one of the convex-shaped triangular-cross-sectional prisms corresponds to at least three concave-rounded vertically-extended portions.

15. A method for forming a sheathing wall in a ground using the guide assembly according to claim 1, wherein the method comprises:

placing a first guide-body having first inner and outer vertical faces and first top and bottom horizontal faces extending in a length-direction thereof, wherein the first inner face is configured such that a plurality of first concave-rounded vertically-extended portions are arranged in a shape thereof the length-direction and are connected to one another;

placing a second guide-body having second inner and outer vertical faces and top and bottom horizontal faces extending in a length-direction thereof, wherein the second inner face is configured in a shape thereof such that a plurality of second concave-rounded vertically-extended portions are arranged in the length-direction and are connected to one another, wherein the second inner face faces away the first inner face;

securing the first and second guide-bodies to each other;

inserting a hollow casing between and into the first and second inner faces of the first and second guide-bodies; and filling and solidifying a pile-forming material into the hollow casing, wherein the first outer face of the first body is configured in a shape thereof such that a plurality of first convex-rounded vertically-extended portions are arranged in the length-direction and are connected to one another; and/or the second outer face of the second body is configured in a shape thereof such that a plurality of second convex-rounded vertically-extended portions are arranged in the length-direction and are connected to one another.

16. The method of claim 15, wherein securing the first and second guide-bodies to each other includes inserting first and second anchoring-bars through first and second anchoring-bar guide channels defined in the first and second guide-bodies respectively into the ground and/or filling water into an empty space defined in each of the first and second guide-bodies, thereby to suppress movement of the first and second guide-bodies, wherein each of the first and second guide-bodies has the empty space at least partially formed therein, wherein the first and second anchoring-bar guide channels vertically pass through the first and second guide-bodies respectively, wherein each of the top face portions of the first and second guide-bodies has a first hole defined therein for introducing water into the empty space; and a second hole defined therein communicating with each of the first and second anchoring-bar guide channels, wherein the guide assembly has first and second covers, wherein the first cover blocks the first hole and the second cover blocks the second hole, wherein each of anchoring-bars includes a micro-pile and a soil-nailing structure inserted through each of the first and second anchoring-bar guide channels into the ground.

17. The method of claim 15, wherein securing the first and second guide-bodies to each other includes using first and/or second coupling units, wherein the first coupling unit is configured to couple the first and second guide-bodies to each other at the first and second top faces thereof, wherein the second coupling unit is configured to couple the first and second guide-bodies to each other at lower positions of the first and second inner faces thereof, wherein the second coupling unit includes first and second box-accommodation recesses defined at the lower positions of the first and second inner faces respectively; first and second coupling boxes inserted into the first and second box-accommodation recesses respectively; and a lower connection member in a form of an elongate bar inserted through and secured to the first and second coupling boxes, wherein the lower connection member enables the coupling between the first and second guide-bodies at the lower positions of the first and second inner faces thereof.

* * * * *